US011515611B2

(12) United States Patent
Yekan et al.

(10) Patent No.: US 11,515,611 B2
(45) Date of Patent: Nov. 29, 2022

(54) TRANSITION IN A MULTI-LAYER SUBSTRATE BETWEEN A SUBSTRATE INTEGRATED WAVEGUIDE PORTION AND A COPLANAR WAVEGUIDE PORTION

(71) Applicant: Metawave Corporation, Palo Alto, CA (US)

(72) Inventors: Taha Shahvirdi Dizaj Yekan, Palo Alto, CA (US); Chiara Pelletti, Palo Alto, CA (US)

(73) Assignee: METAWAVE Corporation, Carlsbad, CA (US)

( * ) Notice: Subject to any disclaimer, the term of this patent is extended or adjusted under 35 U.S.C. 154(b) by 90 days.

(21) Appl. No.: 16/656,483

(22) Filed: Oct. 17, 2019

(65) Prior Publication Data

US 2020/0127386 A1 Apr. 23, 2020

Related U.S. Application Data

(60) Provisional application No. 62/747,131, filed on Oct. 17, 2018.

(51) Int. Cl.

| | |
|---|---|
| ***H01P 5/107*** | (2006.01) |
| ***H01Q 13/18*** | (2006.01) |
| ***H01P 5/08*** | (2006.01) |
| ***H01P 3/00*** | (2006.01) |
| ***H01P 5/10*** | (2006.01) |
| ***H01Q 1/32*** | (2006.01) |
| ***H01P 3/12*** | (2006.01) |
| ***H01Q 21/06*** | (2006.01) |
| *H01P 5/12* | (2006.01) |

(52) U.S. Cl.

CPC ..... *H01P 5/107* (2013.01); *H01P 3/003* (2013.01); *H01P 3/121* (2013.01); *H01P 5/08* (2013.01); *H01P 5/1022* (2013.01); *H01Q 1/3233* (2013.01); *H01Q 13/18* (2013.01); *H01Q 21/064* (2013.01); *H01P 5/12* (2013.01); *H01Q 1/3216* (2013.01)

(58) Field of Classification Search

CPC ..... H01P 1/121; H01P 5/107; H01P 5/103
USPC ..... 333/26, 248
See application file for complete search history.

(56) References Cited

U.S. PATENT DOCUMENTS

| | | | | |
|---|---|---|---|---|
| 6,492,949 | B1 | 12/2002 | Breglia et al. | |
| 7,808,439 | B2 * | 10/2010 | Yang et al. | H01Q 13/22 343/771 |
| 8,633,866 | B2 | 1/2014 | Sarabandi et al. | |
| 8,803,739 | B2 | 8/2014 | Rajgopal et al. | |
| 9,531,052 | B2 * | 12/2016 | Dang et al. | H01L 23/49838 |

(Continued)

OTHER PUBLICATIONS

L. Boccia, et al., "Multilayer Antenna-Filter Antenna for Beam-Steering Transmit-Array Applications," IEEE Trans. on Microwave Theory and Techniques, vol. 60, No. 7, pp. 2287-2300, Jul. 2012.

(Continued)

*Primary Examiner* — Benny T Lee
(74) *Attorney, Agent, or Firm* — Sandra Lynn Godsey

(57) ABSTRACT

Transitional elements to offset a capacitive impedance in a transmission line are disclosed. Described are various examples of transitional elements in a multilayer substrate that introduce a transitional reactance to cancel the transmission line capacitive effects. The transitional elements reduce insertion loss.

20 Claims, 26 Drawing Sheets

(56) References Cited

U.S. PATENT DOCUMENTS

| | | | | |
|---|---|---|---|---|
| 9,905,928 | B2 | 2/2018 | de Rochemont | |
| 2004/0085151 | A1* | 5/2004 | Fukunaga | H01P 3/121 333/26 |
| 2009/0135087 | A1 | 5/2009 | Gummalla et al. | |
| 2010/0253450 | A1* | 10/2010 | Kim et al. | H01P 5/107 333/239 |
| 2014/0375525 | A1 | 12/2014 | Shi | |
| 2016/0372373 | A1* | 12/2016 | Asahi | G02B 6/00 |

OTHER PUBLICATIONS

A.H. Abdelrahman, et al., "Transmission Phase Limit of Multilayer Frequency-Selective Surfaces for Transmitarray Designs," IEEE Trans. on Antennas and Propagation, vol. 62, No. 2, pp. 690-697, Feb. 2014.

* cited by examiner

-- PRIOR ART --

TRANSITION IN A MULTI-LAYER SUBSTRATE BETWEEN A SUBSTRATE INTEGRATED WAVEGUIDE PORTION AND A COPLANAR WAVEGUIDE PORTION

CROSS REFERENCE TO RELATED APPLICATION

The present application claims priority to U.S. Provisional Patent Application Ser. No. 62/747,131, filed on Oct. 17, 2018, which is incorporated by reference in its entirety.

BACKGROUND

Wireless technology is entering a new phase of development with the launch of fifth generation ("5G") networks, Internet of Things ("IoT"), digital content delivery (such as Over the Top ("OTT")), virtual reality, augmented reality, drones, self-driving vehicles, and so forth. This new phase leads to enhanced and constant connectivity, requiring new equipment, modules, and methods for sending and receiving electromagnetic signals. Devices supporting these technologies are often too small to manage multiple functions. Designing such a product involves a circuit configuration such as that built on a printed circuit board ("PCB"), where the board layout includes several layers with interconnects between layers, transitions from structures in one layer to structures in another layer, as well as complex routing. All this while maintaining the integrity of the systems incorporated on the board, such as to avoid losses due to transitions and so forth, is challenging.

These new systems and methods require operation at high frequency, millimeter wave ("mm-wave") bands for which current systems have not been designed. In particular, at such high frequencies, the sensitivity to changes is significant and there is not the flexibility of the current systems. In some aspects, connection of components introduces an unacceptable insertion loss, which is defined as a function of the ratio of output power to input power of a circuit, and relates to the loss of signal power. The insertion loss is incurred by the insertion of a device, circuit, or component into a transmission line. It is typically expressed in decibels ("dB"). It is desirable to reduce insertion losses in a system.

BRIEF DESCRIPTION OF THE DRAWINGS

The present application may be more fully appreciated in connection with the following detailed description taken in conjunction with the accompanying drawings, which may not be drawn to scale and in which like reference characters refer to like parts throughout, and in which.

DETAILED DESCRIPTION OF THE INVENTION

Methods and apparatuses to reduce insertion loss in a circuit design, and are particularly applicable to high frequency transmissions, such as mm-wave transmissions, are disclosed. There are many applications for these solutions, including those as illustrated herein below in a radar system for driver assist and autonomous operation of a vehicle. This is not meant to be limiting, but rather provided for clarity of understanding. Like features are denoted by the same reference labels throughout the specification and may not be described universally throughout the specification.

Figure 15:
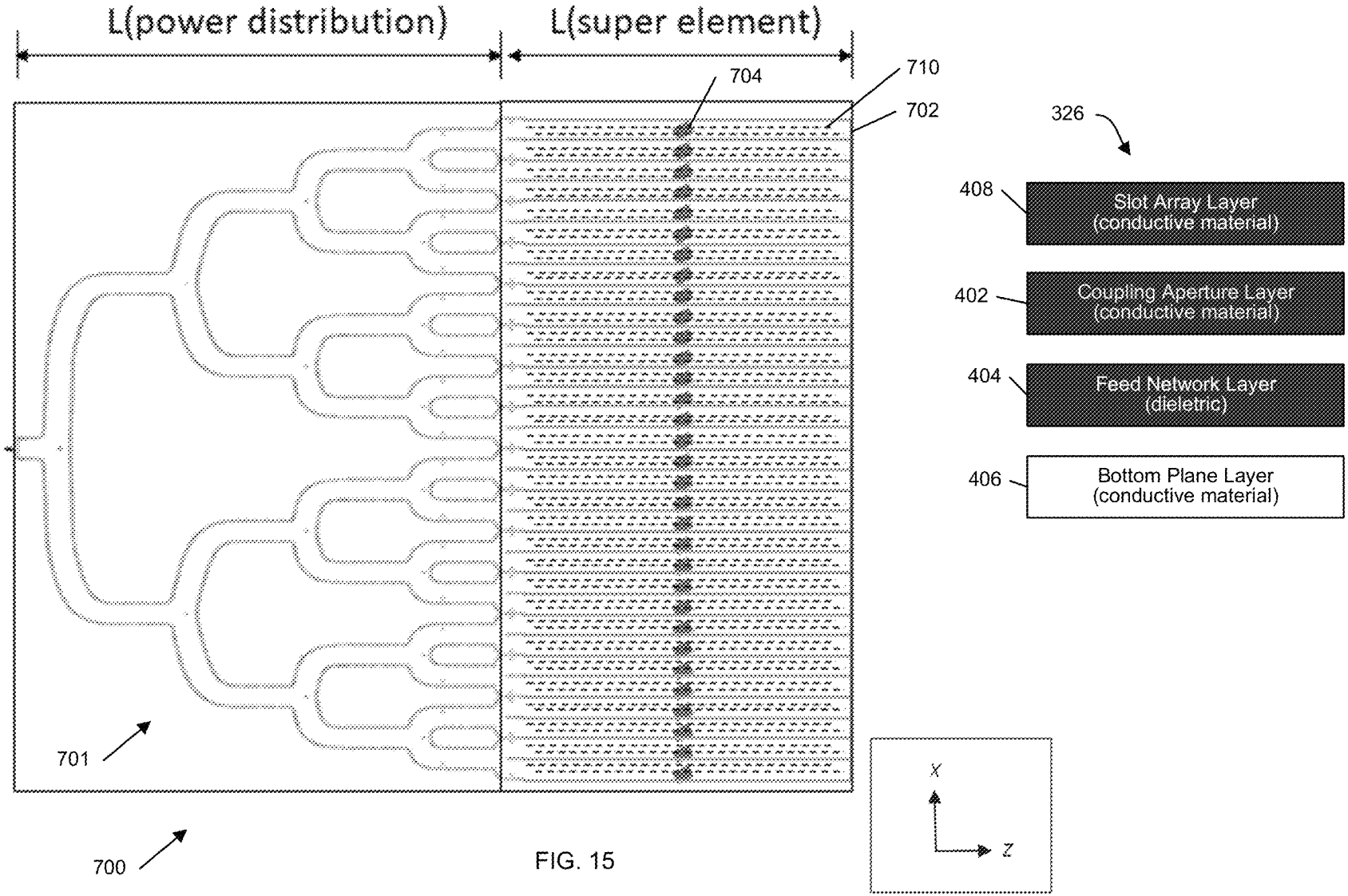
FIG. 15 illustrates construction of a feed network layer, coupling an aperture layer and a slot array layer, according to various implementations of the subject technology.

In some antenna applications, the antenna structure includes a feed network, to provide a signal for transmission, coupled to radiating elements. As illustrated in FIG. 15, an antenna structure 700 includes a feed network 701 and resonating elements 710. In various examples, lengths of transmission lines are referred to as "super element" ("SE") 702, and defined as a set of resonating structures ("RSs") positioned along a propagating waveguide such that collectively they embody a super element ("SE"), which radiates electromagnetic waves with high gain along predefined directions and over a wider frequency band that covers the individual structure resonating frequencies, and when placed in an array, the coupling between SEs is at a minimum. Some designs may prioritize one aspect over another, such as to allow some level of acceptable coupling in order to achieve a wider frequency band. The configuration of the SEs reduces coupling therebetween, and maintains high gain over a range of frequencies.

The SEs 702 may be designed and operated so as to taper the radiation pattern therefrom, as well as to control side lobe power levels and effect phase and/or polarization of the radiated transmission. The common feed point may be a probe feed structure, a single-end fan feed structure, or a double-end fan feed structure. The single-end feed may also be referred to as an "unbounded feed", and the double-end fan feed may also be referred to as a "bounded feed". Each of these structures has benefits and disadvantages.

The antenna structure 700 is a single-end fan feed structure, having the transmission signal divided through feed network 701, and fed to one end of the SEs 702. Each of the SEs 702 includes a plurality of resonating structures, each having a center frequency, where the center frequencies may be different. An example of an SE 702 is illustrated, having resonating elements ("REs") 710 positioned along the length of the transmission line, or SE 702. Each SE 702 is coupled to a terminating end of a transmission path of feed network 701. The position of REs 710 are configured to achieve a high gain over a range of frequencies, while reducing coupling between the REs 710, SEs 702, and other components of the antenna structure 700 by reducing side lobe power levels. These REs 710 collectively focus a radiation pattern, or beam, from the antenna structure 700.

Autonomous driving is quickly moving mainstream, and Advanced-Driver Assistance Systems ("ADAS") that automate, adapt, and enhance vehicles for safety and better driving are de rigueur for drivers. The car must not only communicate with people and machines in the environment of the car and in a remote manner, but all the while, monitor the surrounding environment and driving conditions to respond to events as needed to avoid accidents from traffic, pedestrians, cyclists, animals, and so forth.

An aspect of making this work is the ability to detect and classify targets in the surrounding environment at the same, or possibly even better level, as humans. Humans are adept at recognizing and perceiving the world around them with an extremely complex human visual system that essentially has two main functional parts: the eye and the brain. In autonomous driving technologies, the eye may include a combination of multiple sensors, such as a camera, radar, and lidar, while the brain may involve multiple artificial intelligence, machine learning, and deep learning systems. The goal is to have a full understanding of a dynamic, fast-moving environment in real time, and human-like intelligence to act in response to changes in the environment.

In some examples, a Multi-Layer, Multi-Steering ("MLMS") antenna system for autonomous vehicles that is suitable for many different mm-wave applications, incorporates transitions as disclosed herein. Such systems and methods may be deployed in a variety of different environments and configurations such as those described herein. Mm-wave applications are those operating with frequencies between 30 and 300 Gigahertz ("GHz") or a portion thereof, including autonomous driving applications in the 77 GHz range and 5G applications in the 60 GHz range, among others. In various examples, the MLMS antenna system is incorporated in a radar in an autonomous driving vehicle to detect and identify targets in the vehicle's path and surrounding environment. The targets may include structural elements in the environment such as roads, walls, buildings, road center medians, and other objects, as well as vehicles, pedestrians, bystanders, cyclists, plants, trees, animals, and so on. The MLMS antenna array enables a radar to be a "digital eye" with true 3D vision and human-like interpretation of the world.

It is appreciated that, in the following description, numerous specific details are set forth to provide a thorough understanding of the examples. However, it is appreciated that the examples may be practiced without limitation to these specific details. In other instances, well-known methods and structures may not be described in detail to avoid unnecessarily obscuring the description of the examples. Also, the examples may be used in combination with each other.

Figure 1:
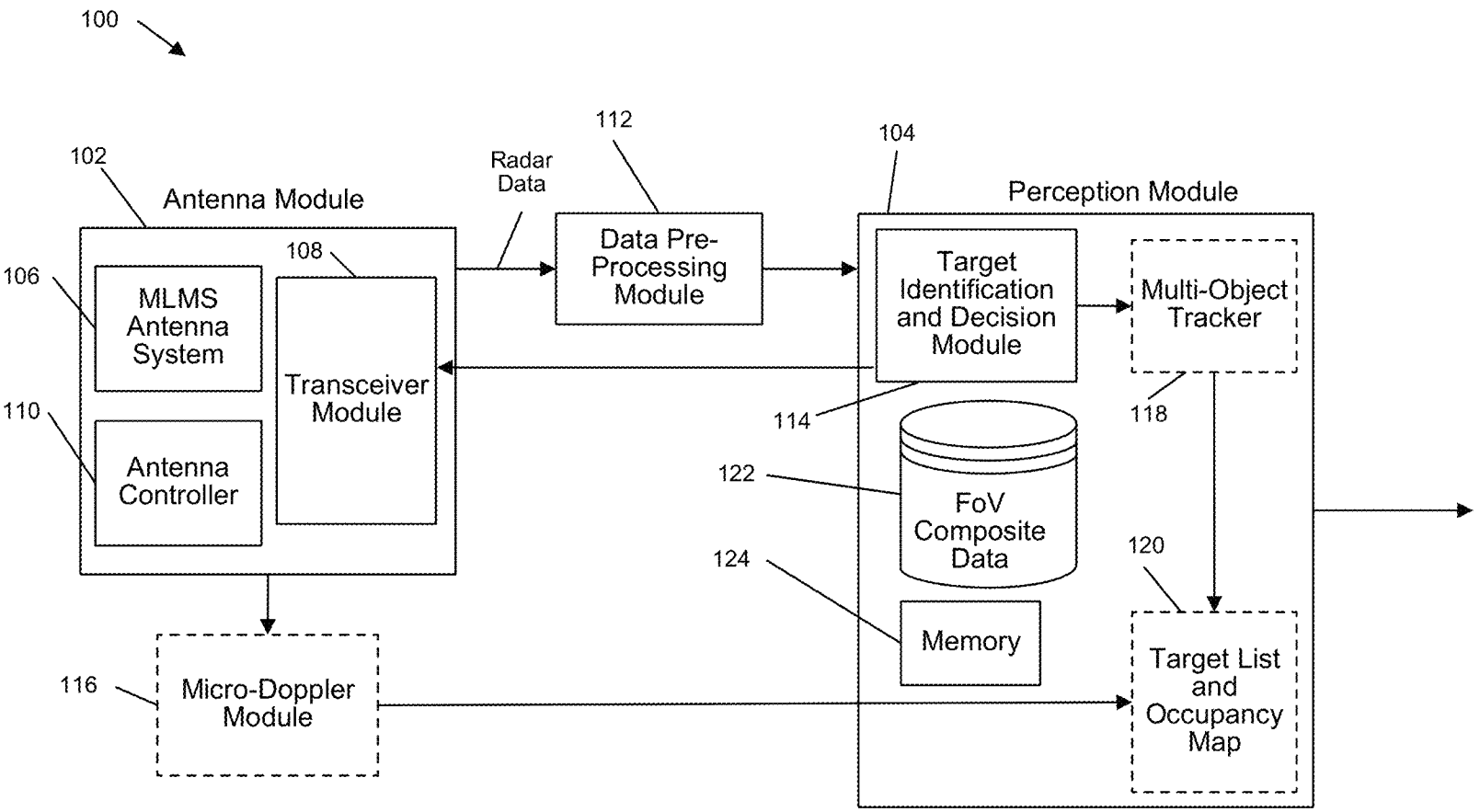
FIG. 1 illustrates a schematic diagram of an integrated circuit ("IC"), such as for a radar system in use in an autonomous driving system, according to various implementations of the subject technology.

FIG. 1 illustrates a schematic diagram of a radar system for use in an autonomous driving system in accordance with various examples. Radar system 100 is a "digital eye" with true three-dimensional ("3D") vision and capable of a human-like interpretation of the world. The "digital eye" and human-like interpretation capabilities are provided by two main modules: antenna module 102 and perception module 104.

Antenna module 102 has an MLMS antenna system 106 to radiate dynamically controllable and highly-directive radio frequency ("RF") beams. A transceiver module 108, coupled to the MLMS antenna system 106, prepares a signal for transmission, such as a signal for a radar device, where the signal is defined by modulation and frequency. The signal is provided to the MLMS antenna system 106 through a coaxial cable or other connector, and propagates through the antenna structure for transmission through the air via RF beams at a given phase, direction, and so on. The RF beams and their parameters (e.g., beamwidth, phase, azimuth and elevation angles, etc.) are controlled by antenna controller 110, such as at the direction of perception module 104.

The RF beams reflect off targets in the vehicle's path and surrounding environment, and the RF reflections are received by the transceiver module 108. Radar data from the received RF beams is provided to the perception module 104 for target detection and identification. A data pre-processing module 112 processes the radar data to encode it for the perception module 104. In various examples, the data pre-processing module 112 could be a part of the antenna module 102 or the perception module 104, such as on the same circuit board as the other modules within the antenna or perception modules 102, 104. The data pre-preprocessing module 112 may process the radar data through an autoencoder, a non-line-of-sight network, a super-resolution network, or a combination of networks for improving the training and performance of the perception module 104.

The radar data may be organized in sets of Range-Doppler ("RD") map information, corresponding to four-dimensional ("4D") information that is determined by each RF beam radiated off of targets, such as azimuthal angles, elevation angles, range, and velocity. The RD maps may be extracted from Frequency-Modulated Continuous-Wave ("FMCW") radar pulses, and contain both noise and systematic artifacts from Fourier analysis of the pulses. The perception module 104 controls further operation of the antenna module 102 by, for example, providing beam parameters for the next RF beams to be radiated from the MLMS antenna system 106.

In operation, the antenna controller 110 is responsible for directing the MLMS antenna system 106 to generate RF beams with determined parameters such as beamwidth, transmit angle, and so on. The antenna controller 110 may, for example, determine the parameters at the direction of the perception module 104, which may at any given time want to focus on a specific area of a field of view ("FoV") upon identifying targets of interest in the vehicle's path or surrounding environment. The antenna controller 110 determines the direction, power, and other parameters of the beams and controls the MLMS antenna system 106 to achieve beam steering in various directions. The antenna controller 110 also determines a voltage matrix to apply to reactance control mechanisms coupled to the MLMS antenna system 106 to achieve a given phase shift. Perception module 104 provides control actions to the antenna controller 110 at the direction of the target identification and decision module 114.

Next, the MLMS antenna system 106 radiates RF beams having the determined parameters. The RF beams are reflected off of targets in and around the vehicle's path (e.g., in a 360° field of view) and are received by the transceiver module 108 in antenna module 102. The antenna module 102 transmits the received 4D radar data to the data pre-processing module 112 for encoding radar data that is then sent to the perception module 104. A micro-doppler module 116, coupled to the antenna module 102 and the perception module 104, extracts micro-doppler signals from the 4D radar data to aid in the identification of targets by the perception module 104. The micro-doppler module 116 takes a series of RD maps from the antenna module 102 and extracts a micro-doppler signal from them. The micro-doppler signal enables a more accurate identification of targets as the micro-doppler signal provides information on the occupancy of a target in various directions. Non-rigid targets, such as pedestrians and cyclists, are known to exhibit a time-varying doppler signature due to swinging arms, legs, etc. By analyzing the frequency of the returned radar signal over time, it is possible to determine the class of the target (i.e., whether the target is a vehicle, pedestrian, cyclist, animal, etc.) with over 90% accuracy. Further, as this classification may be performed by a linear Support Vector Machine ("SVM"), it is extremely computationally efficient. In various examples, the micro-doppler module 116 could be a part of the antenna module 102 or the perception module 104, such as on the same circuit board as the other modules within the MLMS antenna system 106 or modules 102, 104.

The target identification and decision module 114 receives the encoded radar data from the data pre-processing module 112, processes the encoded data to detect and identify targets, and determines the control actions to be performed by the antenna module 102 based on the detection and identification of such targets. For example, the target identification and decision module 114 may detect a cyclist on the path of the vehicle and direct the antenna module 102, at the instruction of its antenna controller 110, to focus additional RF beams at a given phase shift and direction within the portion of the FoV corresponding to the cyclist's location.

The perception module 104 may also include a multi-object tracker 118 to track the identified targets over time, such as, for example, with the use of a Kalman filter. The multi-object tracker 118 matches candidate targets identified by the target identification and decision module 114 with targets the multi-object tracker 118 has detected in previous time windows. By combining information from previous measurements, expected measurement uncertainties, and some physical knowledge, the multi-object tracker 118 generates robust, accurate estimates of the target locations.

Information on identified targets over time is then stored at a target list and occupancy map 120, which keeps tracks of the targets' locations and their movement over time as determined by the multi-object tracker 118. The tracking information provided by the multi-object tracker 118 and the micro-doppler signal provided by the micro-doppler module 116 are combined to produce an output containing the type/class of the target identified, their location, their velocity, and so on. This information from the radar system 100 is then sent to a sensor fusion module in the vehicle, where this information is processed together with information from other sensors in the vehicle.

In various examples, an FoV composite data unit 122 stores information that describes an FoV. This may be historical data used to track trends and anticipate behaviors and traffic conditions, or may be instantaneous or real-time data that describes the FoV at a moment in time or over a window in time. The ability to store this data enables the perception module 104 to make decisions that are strategically targeted at a particular point or area within the FoV. For example, the FoV may be clear (e.g., no echoes received) for five minutes, and then one echo arrives from a specific region in the FoV; this is similar to detecting the front of a car. In response, the perception module 104 may determine to narrow the beamwidth for a more focused view of that sector or area in the FoV. The next scan may indicate the targets' length or other dimension, and if the target is a car, the perception module 104 may consider what direction the target is moving and focus the beams on that area. Similarly, the echo may be from a spurious target, such as a bird, which is small and moving quickly out of the path of the car. There are a variety of other uses for the FoV composite data 122, including the ability to identify a specific type of target based on previous detection. A memory 124 stores useful data for the radar system 100, such as, for example, information on which subarrays of the MLMS antenna 106 perform better under different conditions.

In various examples described herein, the use of radar system 100 in an autonomous driving vehicle provides a reliable way to detect targets in difficult weather conditions. For example, historically a driver will slow down dramatically in thick fog, as the driving speed decreases with decreases in visibility. On a highway in Europe, for example, where the speed limit is 115 km/h, a driver may need to slow down to 40 km/h when visibility is poor. Using the radar system 100, the driver (or driverless vehicle) may maintain the maximum safe speed without regard to visibility. Even if other drivers slow down, a vehicle enabled with the radar system 100 will be able to detect those slow-moving vehicles and obstacles in the way and avoid/navigate around them.

Additionally, in highly congested areas, it is necessary for an autonomous vehicle to detect targets in sufficient time to react and take action. The examples provided herein for a radar system increase the sweep time of a radar signal so as to detect any echoes in time to react. In rural areas and other areas with few obstacles during travel, the perception module 104 adjusts the focus of the beam to a larger beamwidth, thereby enabling a faster scan of areas where there are few echoes. The perception module 104 may detect this situation by evaluating the number of echoes received within a given time period and making beam size adjustments accordingly. Once a target is detected, the perception module 104 determines how to adjust the beam focus. This is achieved by changing the specific configurations and conditions of the MLMS antenna 106.

All of these detection scenarios, analysis, and reactions may be stored in the perception module 104 and used for later analysis or simplified reactions. For example, if there is an increase in the echoes received at a given time of day or on a specific highway, that information is fed into the antenna controller 110 to assist in proactive preparation and configuration of the MLMS antenna system 106. Additionally, there may be some subarray combinations that perform better, such as to achieve a desired result, and this is stored in the memory 124.

Figure 2:
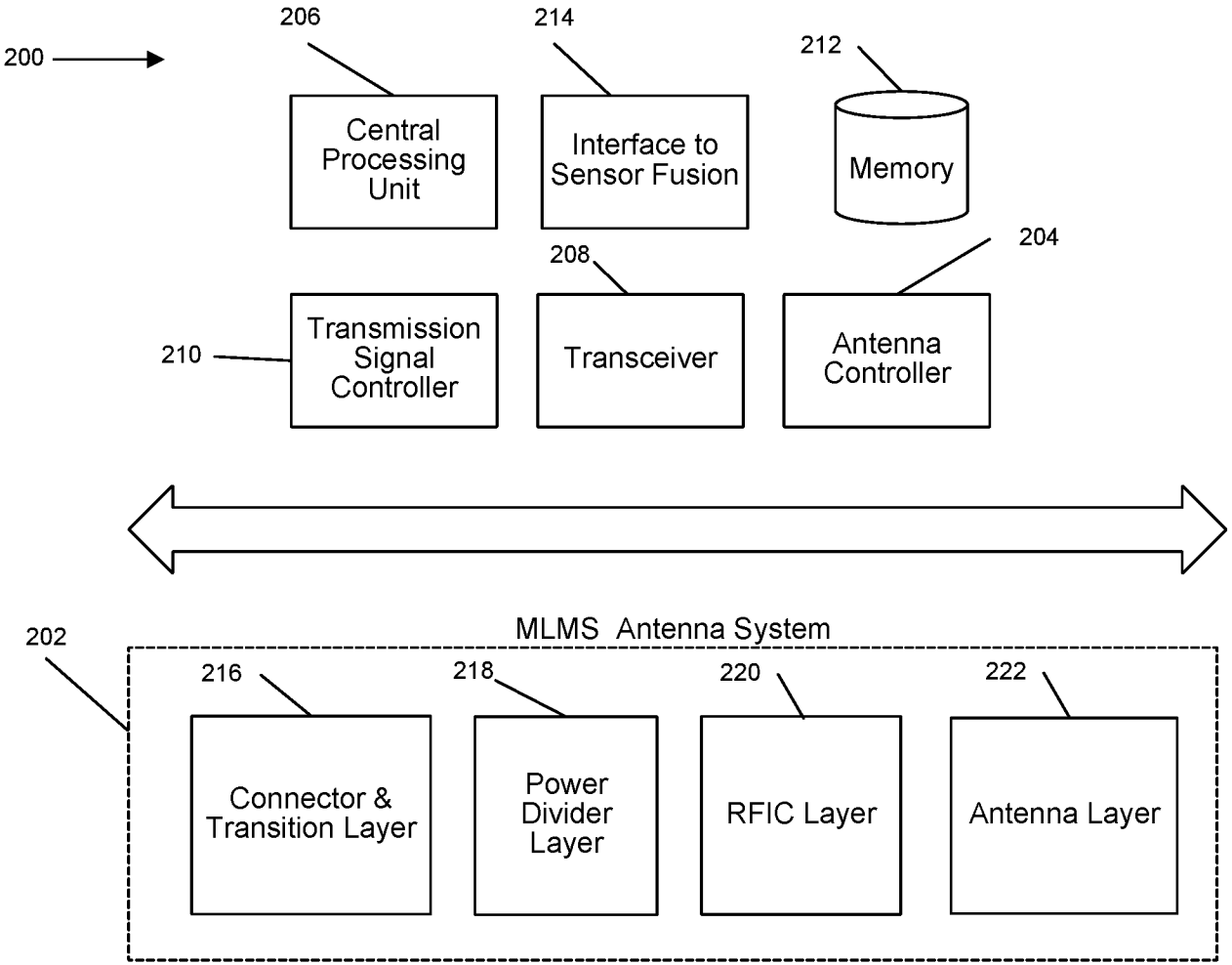
FIG. 2 is a schematic diagram of an antenna module for use with the radar system of FIG. 1, according to various implementations of the subject technology.

Attention is now directed at FIG. 2, which shows a schematic diagram of an antenna module for use with the radar system of FIG. 1, in accordance with various examples. The MLMS antenna module 200 has an MLMS antenna system 202 coupled to an antenna controller 204, a central processing unit 206, and a transceiver 208. A transmission signal controller 210 generates the specific transmission signal, such as an FMCW signal, which is used for radar sensor applications as the transmitted signal is modulated in frequency or phase. The FMCW signal enables a radar to measure range to a target by measuring the phase differences in phase or frequency between the transmitted signal and the received or reflected signal. Within FMCW formats, there are a variety of modulation patterns that may be used within the FMCW, including, but not limited to, triangular, sawtooth, rectangular, and so forth, each having advantages and purposes. For example, a sawtooth modulation may be used for large distances to a target, a triangular modulation enables use of the Doppler frequency, and so forth.

Other modulation types may be incorporated according to the desired information and specifications of a system and application. For example, the transmission signal controller 210 may also generate a cellular modulated signal, such as an Orthogonal Frequency Division Multiplexed ("OFDM") signal. In some examples, the signal is provided to the antenna module 200, and the transmission signal controller 210 may act as an interface, translator, modulation controller, or otherwise as required for the signal to propagate through a transmission line system. The received information is stored in a memory storage unit 212, where the information structure may be determined by the type of transmission and modulation pattern.

In various examples, the MLMS antenna system 202 radiates the signal through a structure built on a PCB consisting of four main layers: (1) a connector and transition layer 216, (2) a power divider layer 218, (3) a radio-frequency integrated-circuit ("RFIC") layer 220, and (4) an antenna layer 222. The connector and transition layer 216 couples the transmission signal from the transmission signal controller 210 to the PCB for transmission to the power divider layer 218. The power divider layer 218 is a corporate feed structure having a plurality of transmission lines for transmitting the signal to the antenna layer 222. The antenna layer 222 includes a plurality of radiating slots for radiating the signal into the air. The slots are configured in a specific pattern as described below, but other patterns, shapes, dimensions, orientations, and specifications may be used to achieve a variety of radiation patterns. The RFIC layer 220 includes phase shifters (e.g., a varactor, a set of varactors, or a phase shift network) to achieve any desired phase shift from 0° to 360°. The RFIC layer 220 also includes transitions from the power divider layer 218 to the RFIC layer 220, and from the RFIC layer 220 to the antenna layer 222.

Note that, as illustrated, there is one MLMS antenna system 202 in the MLMS antenna module 200. However, an MLMS antenna module 200 may have multiple MLMS antenna systems 202 in any given configuration. For example, a set of MLMS antenna systems 202 may be designated as transmit antennas, and another set of MLMS antenna systems 202 may be designated as receive antennas. Further, an MLMS antenna system 202 may radiate beams orthogonal to the beams radiated by another MLMS antenna system 202. Different MLMS antenna systems 202 may also have different polarizations. In various examples, different MLMS antenna systems 202 may be configured to detect different targets (e.g., a set of MLMS antenna systems 202 may be configured to enhance the detection and identification of pedestrians, another set of MLMS antenna systems 202 may be configured to enhance the detection and identification of vehicles, and so forth). In the case of pedestrians, the configuration of MLMS antenna systems 202 may include power amplifiers to adjust the power of a transmitted signal and/or different polarization modes for different arrays to enhance pedestrian detection. It is appreciated that numerous configurations of MLMS antenna systems 202 may be implemented in a given antenna module 200.

In operation, the antenna controller 204 receives information from other modules in the antenna module 200 and/or from the perception module 104 in FIG. 1 indicating a next radiation beam, where a radiation beam may be specified by parameters such as beamwidth, transmit angle, transmit direction, and so forth. The antenna controller 204 determines a voltage matrix to apply to reactance control mechanisms in the antenna array of the MLMS antenna system 202 to achieve a given phase shift or other parameters.

Transceiver 208 prepares a signal for transmission, such as a signal for a radar device, where the signal is defined by modulation and frequency. The signal is received by the MLMS antenna system 202, and the desired phase of the radiated signal is adjusted at the direction of the antenna controller 204. In some examples, the MLMS antenna system 202 can be implemented in many applications, including radar, cellular antennas, and autonomous vehicles to detect and identify targets in the path of or surrounding the vehicle. Alternate examples may use the MLMS antenna system 202 for wireless communications, medical equipment, sensing, monitoring, and so forth. Each application type incorporates designs and configurations of the elements, structures, and modules described herein to accommodate their needs and goals.

In antenna module 200, a signal is specified by antenna controller 204, which may be directed by a perception module (e.g., perception module 104 in FIG. 1), a sensor fusion module via an interface to sensor fusion 214, or it may be based on program information from memory storage 212. There are a variety of considerations to determine the beam formation, where this information is provided to antenna controller 204 to configure the various elements of the MLMS antenna system 202, which are described herein below. The transmission signal controller 210 generates the transmission signal and provides the transmission signal to the MLMS antenna system 202, such as through a coaxial cable or other connector. The signal propagates through the connector and transition layer 216 to the antenna layer 222 for transmission through the air.

The antenna layer 222 may be referred to as a type of slotted waveguide antenna ("SWA"), wherein the power divider layer 218 acts as a feed to the antenna layer 222. Alternate examples may reconfigure and/or modify the antenna structure to improve radiation patterns, bandwidth, side lobe levels, and so forth. The antenna performance may be adjusted by design of the antenna's features and materials, such the shape of the slots, slot patterns, slot dimensions, conductive trace materials, and patterns, as well as other modifications to achieve impedance matching and so forth.

Figure 3:
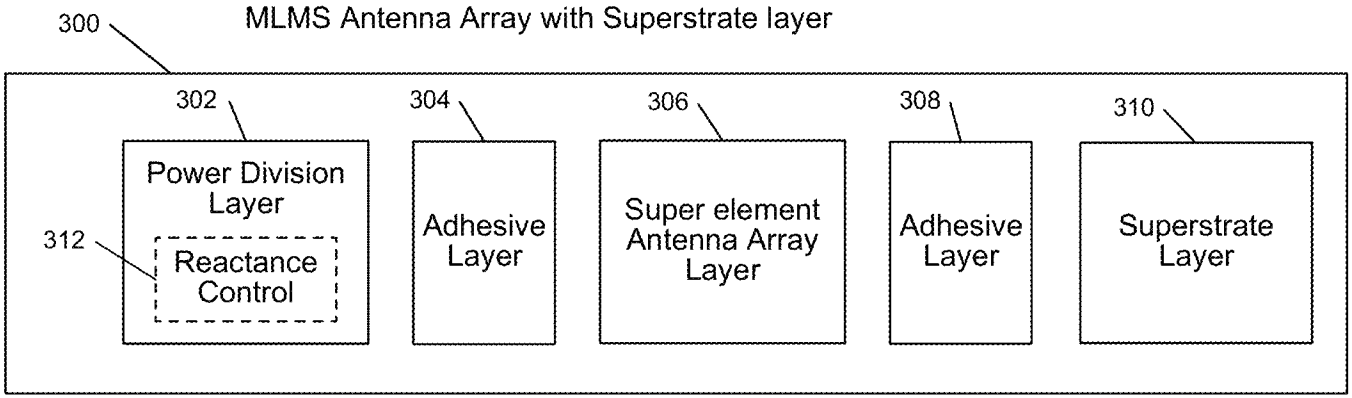
FIG. 3 is a schematic diagram of an antenna system for use with the antenna module of FIG. 2, according to various implementations of the subject technology.

Attention is now directed to FIGS. 3-6, which illustrate other examples of an MLMS antenna array for use in the antenna module 200 of FIG. 2. In the example of FIG. 3, the MLMS antenna array 300 has a power division layer 302, a super element (SE) antenna array layer 306, and a superstrate layer 310. The power division layer 302 includes transmission path configurations to distribute a single transmission path across multiple paths leading to the SEs of SE antenna array layer 306. Adhesive layer 304 is positioned between the SE antenna array layer 306 and the power division layer 302. The power division layer 302 in some examples includes reactance control module 312 for achieving different phase shifts in the radiated RF signals. The reactance control module 312 may include an RF integrated circuit having a varactor, a network of varactors, a phase shift network, a vector modulator architecture, or another circuit to achieve phase shifts anywhere from 0° to 360° degrees, and thereby enable full scanning of an entire FoV. An adhesive layer 308 is positioned between the superstrate layer 310 and the SE antenna array layer 306. In some examples, connections between the layers may be formed by conductors positioned throughout the various layers. Additional layers, such as grounding or reference layers, are not illustrated in FIG. 3, but may be included in a complete construction. In this way, a portion of the SE antenna array layer 306 may couple to a ground layer not shown through the power division layer 302.

In some examples, the SE antenna array layer 306 includes a configuration of transmission lines forming the SEs of the antenna array. The configuration may be positioned in a variety of directions, and may have connections and couplings through the various layers of the MLMS antenna array 300. When the antenna is built in an integrated circuit (IC), the connections may take more than one layer to implement due to space and design constraints. In these configurations, various transition mechanisms are implemented to reduce losses and increase bandwidth over which the device operates. These transition devices and mechanisms are described hereinbelow.

Figure 7:
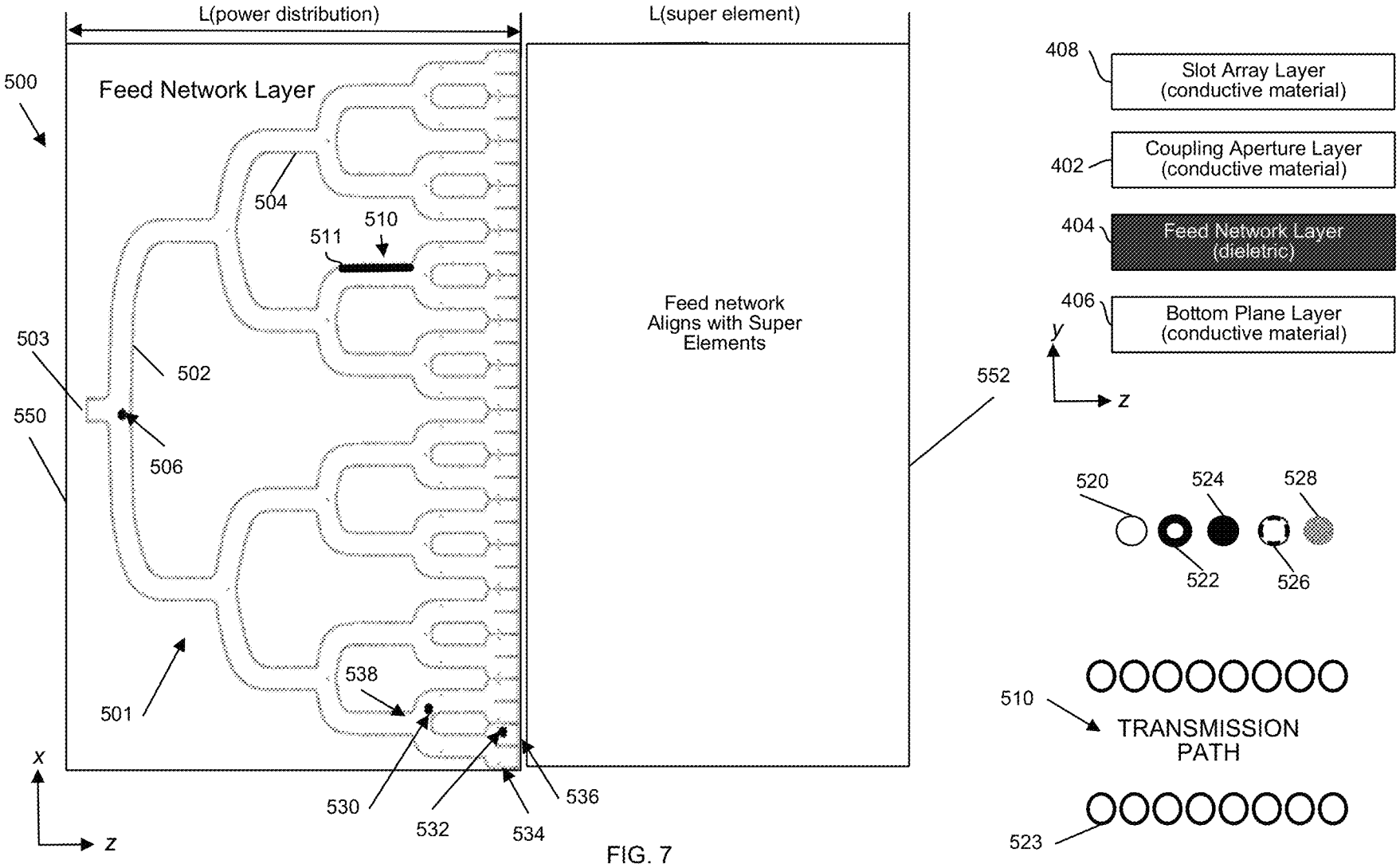
FIG. 7 illustrates a feed network layer, according to various implementations of the subject technology.

In some examples, the power division layer 302 includes a power division network, such as network 500 of FIG. 7 described herein, where the power division network is coupled to the SE element antenna array layer 306 through a fan formation in an effectively parallel plane. In some examples, the power division network is formed as a probe feed to the SEs within the SE antenna array layer 306. The design considerations are used to determine the exact configurations. For example, a dimensional footprint for a given application may indicate the specific configuration, as may the operating requirements. These designs are very flexible to alternate arrangements.

Figure 4:
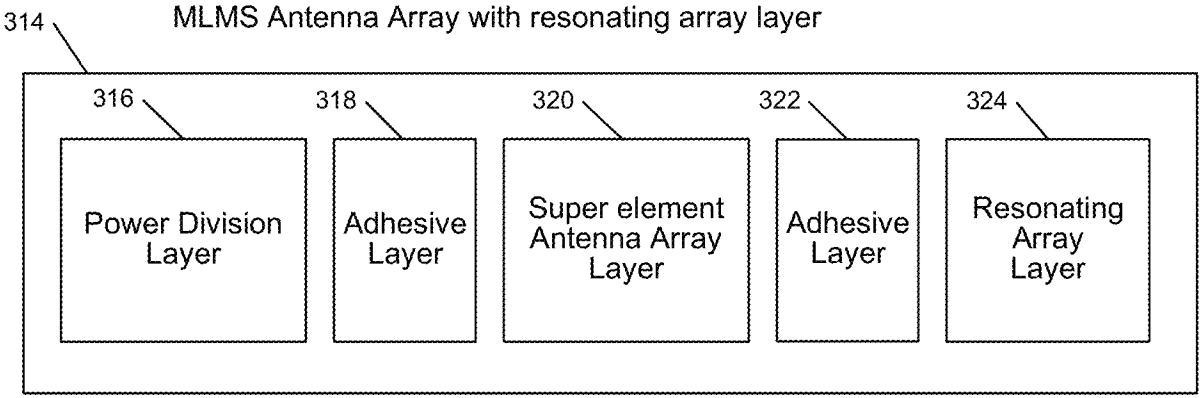
FIG. 4 is a schematic diagram of another antenna system for use with the antenna module of FIG. 2, according to various implementations of the subject technology.

In the example of FIG. 4, similar to the example of FIG. 3, an MLMS antenna array 314 includes a power division layer 316 and a super element (SE) antenna array layer 320, similar to layers 302 and 306 of FIG. 3, and having an adhesive layer 318 therebetween. In this example, there is a resonating array layer 324 that is coupled to the SE antenna array layer 320. An adhesive layer 322 is in between the resonating array layer 324 and SE antenna array layer 320. In the MLMS antenna array 314, reactance control is provided by the resonating array layer 324, which may include specific circuitry to achieve phase shifts and directional control of the transmission beams, and which may be include metamaterial ("MTM") cells in an MTM array layer (e.g., the resonating array layer 324). This may be provided in place of the superstrate layer 310 of FIG. 3 or may be configured with the superstrate layer 310. The MTM array layer is composed of individual MTM cells. In some examples, each MTM cell is of uniform size and shape. In other examples, the MTM cells incorporate different sizes, shapes, configurations, and array sizes. Each MTM cell may include a conductive outer portion, or loop, surrounding a conductive area with a space in between. Each cell may be configured on a dielectric layer, with the conductive areas and loops provided around and between different cells. A voltage controlled variable reactance device embedded on each MTM cell (e.g., a varactor) provides a controlled reactance between the conductive area and the conductive loop. The controlled reactance is controlled by an applied voltage, such as an applied reverse bias voltage in the case of a varactor. The change in reactance changes the behavior of the MTM cell, thereby enabling the MTM array layer to provide focused, high gain beams directed to a specific location.

As generally described herein, an MTM cell is an artificially structured element used to control and manipulate physical phenomena, such as the electromagnetic ("EM") properties of a signal such as amplitude, phase, and wavelength. Metamaterial structures behave as derived from inherent properties of their constituent materials, as well as from the geometrical arrangement of these materials, with size and spacing that are much smaller relative to the scale of spatial variation of typical applications. A metamaterial is a geometric design of a material, such as a conductor, where the shape creates a unique behavior for the device. An MTM cell may be composed of multiple microstrips, gaps, patches, vias, and so forth having a behavior that is the equivalent to a reactance element, such as a combination of series capacitors and shunt inductors. Various configurations, shapes, designs, and dimensions are used to implement specific designs and meet specific constraints. In some examples, the number of dimensional freedoms determines the characteristics, where a device having a number of edges and discontinuities may model a specific-type of electrical circuit and behave in a similar manner. In this way, an MTM cell radiates according to its configuration. Changes to the reactance parameters of the MTM cell result in changes to the radiation pattern thereof. Where the radiation pattern is changed by a phase change or phase shift, the resultant structure is a powerful antenna or radar, as small changes to the MTM cell can result in large changes to the beamform. The array of cells are configured so as to form a composite beamform. This may involve subsets of the cells or the entire array. The composite beamform has a phase shift determined by the compilation of the signals radiating from each cell in response to an input transmission signal. In some examples, the input is a single transmission signal, which may be divided into a plurality of transmission paths. In other examples, the input includes multiple transmission signals presented at different locations to the radiating array structure of the resonating array layer 324.

The MTM cells include a variety of conductive structures and patterns, such that a received transmission signal is radiated therefrom. In various examples, each MTM cell has some unique properties. These properties may include a negative permittivity and permeability resulting in a negative refractive index; these structures are commonly referred to as left-handed materials ("LHM"). The use of LHM enables behavior not achieved in classical structures and materials, including interesting effects that may be observed in the propagation of electromagnetic waves, or transmission signals. Metamaterials can be used for several interesting devices in microwave and terahertz engineering such as antennas, sensors, matching networks, and reflectors, such as in telecommunications, automotive and vehicular, robotic, biomedical, satellite, and other applications. For antennas, metamaterials may be built at scales much smaller than the wavelengths of transmission signals radiated by the metamaterial. Metamaterial properties come from the engineered and designed structures rather than from the base material forming the structures. Precise shape, dimensions, geometry, size, orientation, arrangement, and so forth result in the smart properties capable of manipulating EM waves by blocking, absorbing, enhancing, or bending waves.

Figure 5:
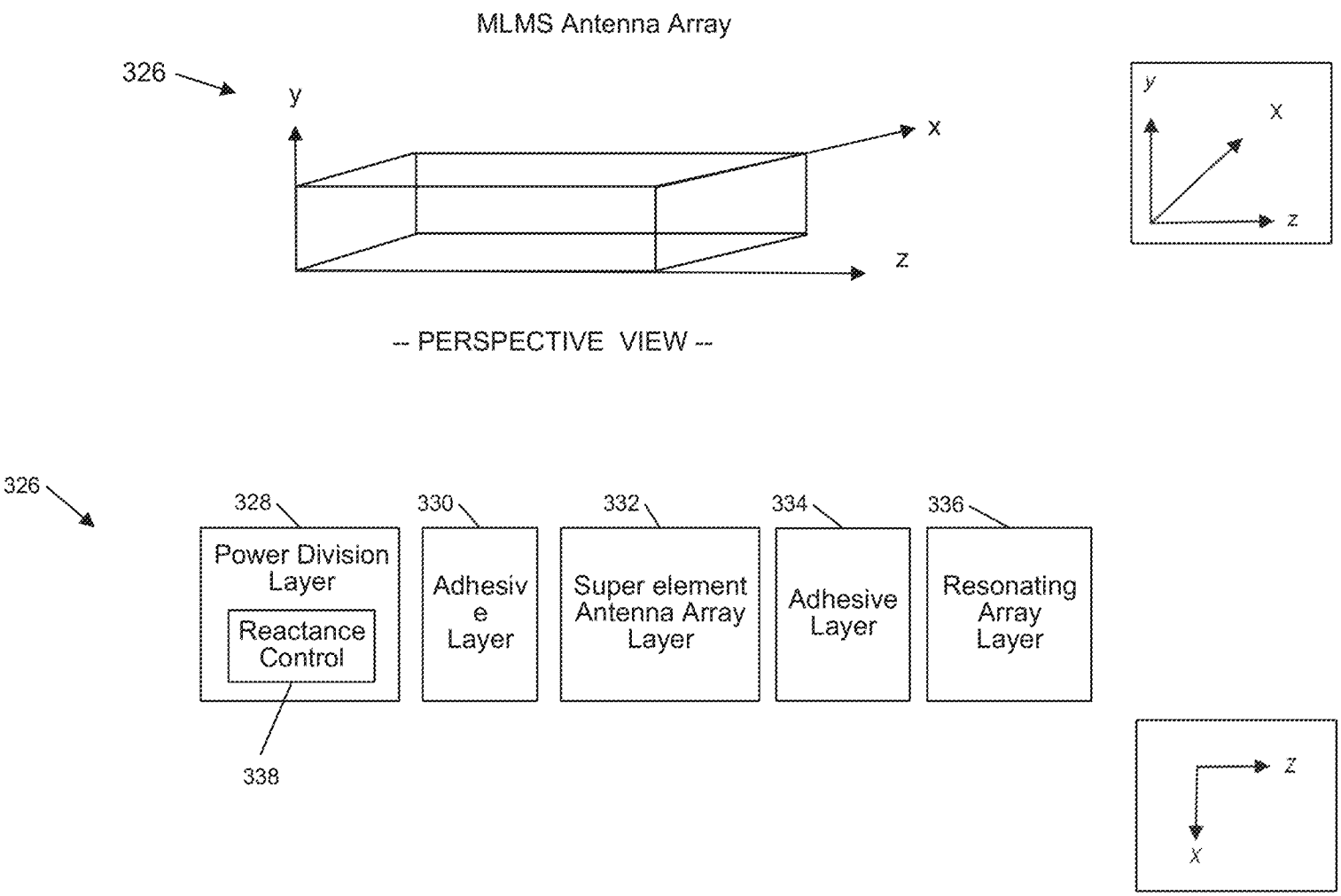
FIG. 5 illustrates a perspective view of the antenna system of FIG. 3, according to various implementations of the subject technology.

FIG. 5 illustrates a perspective view and a schematic functional diagram of an MLMS antenna array 326. The MLMS antenna array 326 enables reactance control through a reactance control module 338 in power division layer 328 as well as through reactance control devices in resonating array layer 336, such as through a varactor coupled to at least one MTM cell. The MLMS antenna array 326 also has a super element (SE) antenna array layer 332, similar to the SE antenna array layers 306 and 320 of FIGS. 3 and 4, respectively. As described in more detail below, each power division layer and SE antenna array layer, of MLMS antenna arrays 202 of FIG. 2, 300 of FIG. 3, 314 of FIG. 4, and 326 of FIG. 5, has multiple conductive layers, such as made of copper, surrounding a dielectric layer sandwiched therebetween. Between power division layer 328 and SE antenna array layer 332 sits an adhesive layer 330. Between SE antenna array layer 332 and resonating array layer 336 sits an adhesive layer 334.

Figure 6:
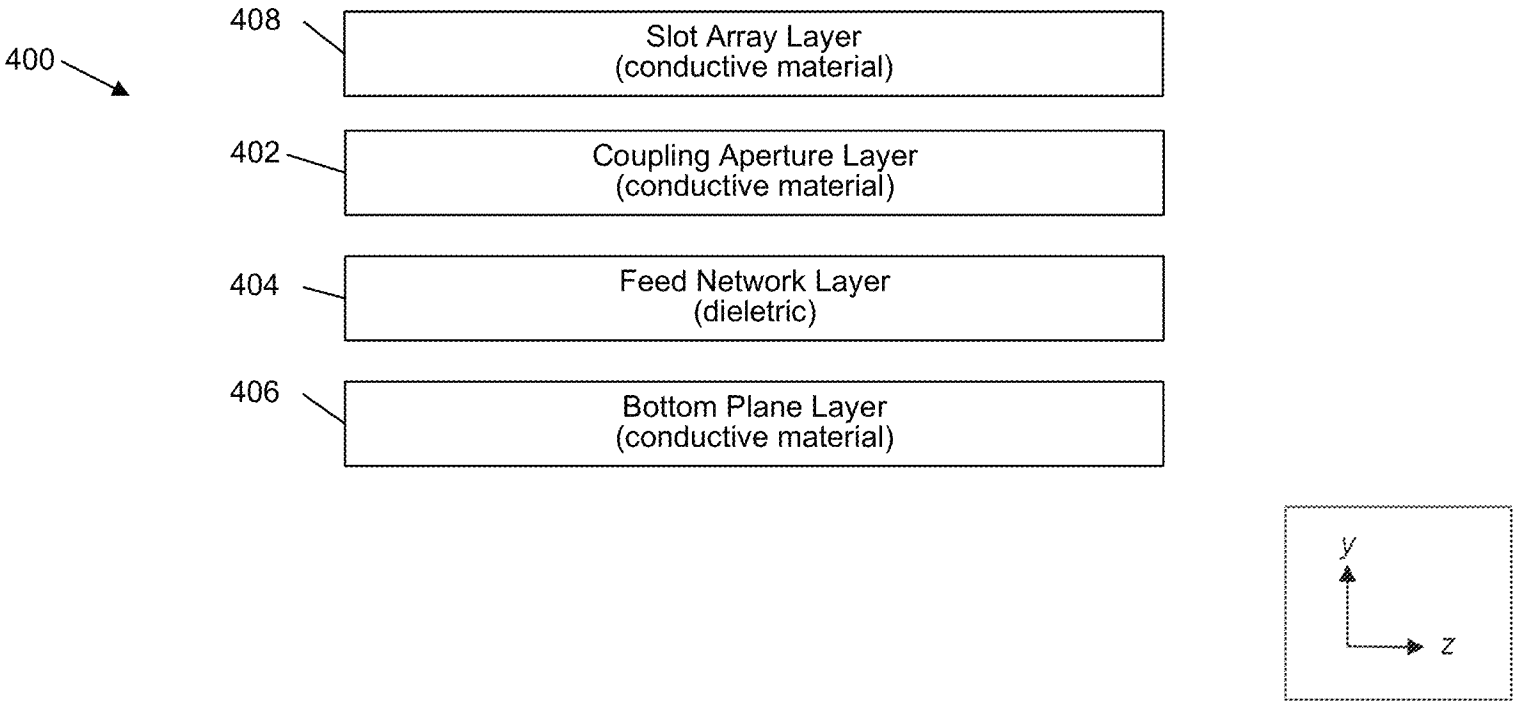
FIG. 6 illustrates a board stack-up configuration for the antenna system of FIG. 3, according to various implementations of the subject technology.

FIG. 6 illustrates a power division layer 400 for use with an antenna structure having an SE antenna array layer coupled to a resonating array layer, in accordance with various examples. Substrate (e.g., power division layer) 400 has two conductive layers surrounding a dielectric layer. The two conductive layers include a bottom plane layer 406 and a coupling aperture layer 402. The bottom plane layer 406 is a conductive material layer having a connector and a line of parallel vias for connecting the transmitting signal to the MLMS antenna array. The coupling aperture layer 402 has a plurality of coupling apertures for effectively feeding signals from the feed network layer 404 into the SEs of an SE antenna array layer placed on top of the substrate. The feed network layer 404 is configured within a dielectric layer, providing conductive transmission paths, such as illustrated from a top view in FIG. 7. A slot array layer 408 is positioned proximate a coupling aperture layer 402. Note that the layers are provided as an example structure, and alternate substrate configurations may be implemented. FIG. 6 illustrates an exemplary configuration of the layers, and will be used for reference throughout this document.

FIG. 7 illustrates a feed network layer 500, similar to feed network layer 404, detailing a corporate divide structure for propagation of a received transmission signal, such as received from a transmission signal controller (e.g., transmission signal controller 210 of FIG. 2), for propagation to a coupling aperture layer such as layer 402, and/or to a slot array layer such as layer 408. In the present example, the configuration includes both of these layers. In the illustrated example, the feed network layer 500 is a type of a power divider circuit (for example, indicated as L(power distribution)) such that the feed network layer 500 takes an input signal and divides the input signal through a network of paths or transmission lines. The feed network layer 500 has two portions, a first portion 550 having the feed network 501, and a second portion 552 corresponding to the location of super elements in another layer. The super elements will overlay the second portion 552 in the device as constructed. The dimensions of the portions 550, 552 are not necessarily drawn to scale, but are provided as examples of the layout. Note that the feed network portion 550 has a length in the z-direction of L(power distribution), and the super element portion 552 has a length in the z-direction of L(super element), which are not necessarily equal, but may have different dimensions. The super element portion 552 may be a dielectric or other non-conductive structure or material.

Figure 8:
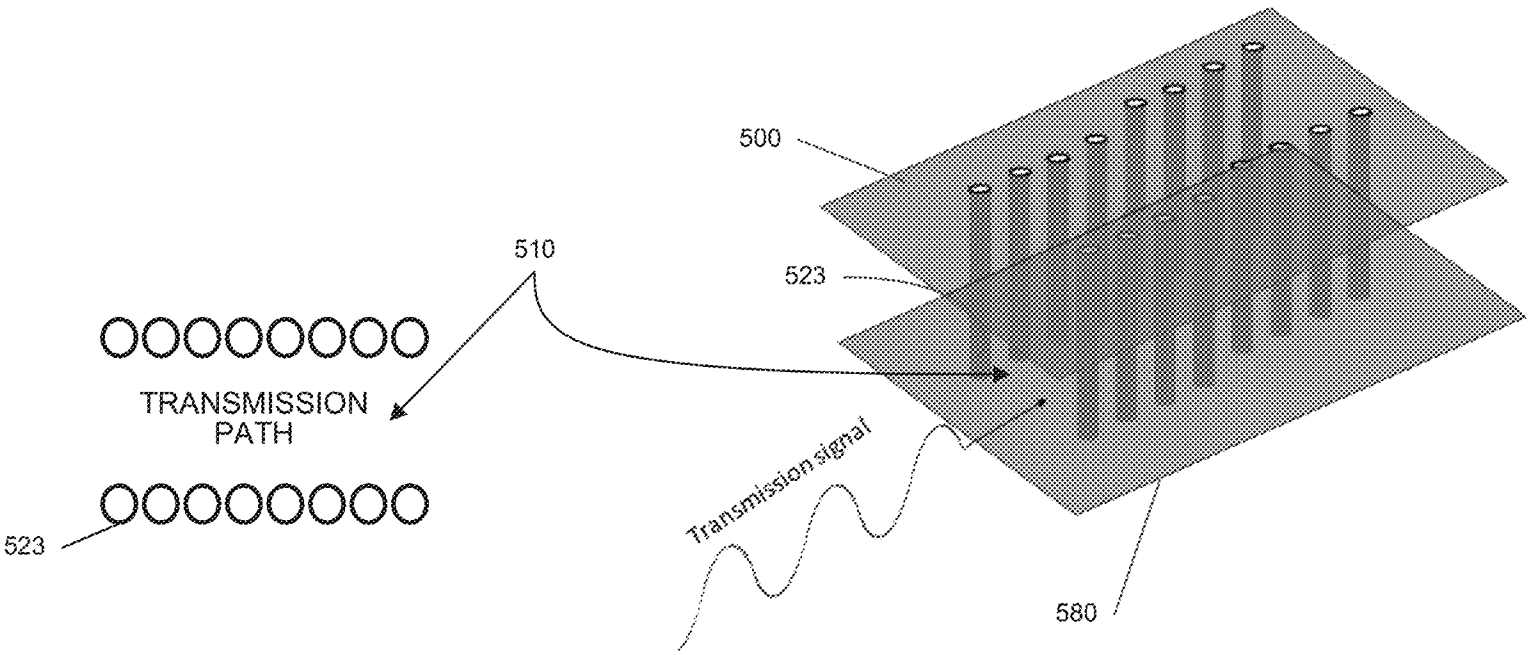
FIG. 8 illustrates a portion of a transmission path formed by a series of vias, according to various implementations of the subject technology.

The feed network 501 is formed on a conductive layer (i.e. feed network layer 500) having transmission paths and division points. The transmission paths are formed by coupling two (or more) conductive layers together using vias constructed along a pattern of a transmission path. A transmission path has sides defined by the coupling vias through a dielectric layer sandwiched between the feed network layer 500 and another conductive layer (not shown). FIG. 8 illustrates a portion of a transmission path from a different perspective. A conductive plate is provided on one side, and another conductive plate is placed on the opposite side. The transmission signal propagates through the dielectric material, and is maintained in each path bounded by conductive vias. The paths direct the signal to multiple connect points, such as connection segments 534 and 536 of FIG. 7 through which the transmission signal propagates to a next part of the transmission structure and toward the radiating elements.

In the present example, the paths have approximately the same dimensions. In alternate examples, the dimensions of the transmission paths may be sized and configured to achieve a desired transmission and/or radiation result. For example, the sizing may allow for more or less power on the edges of a feed network layer 500, or may adjust the power over the connection segments, such as connection segments 534, 536. Each transmission line is a path in the feed network 501, where at various points or levels in the feed network 501, the paths divide into multiple paths. The feed network 501 is designed to be impedance-matched, such that the impedances at each end of a transmission line matches the characteristic impedance of the line (i.e. the source impedance matches the load impedance and the line impedance). This means that the reactive components, such as capacitance and inductance, will ideally cancel out across the network. This enables the system to achieve maximum power transfer over the transmission lines. If this is not the case, then standing waves develop along the transmission line, and power is reflected back toward the source as return loss, or it is lost entirely.

FIG. 8 illustrates a transmission path 510 formed between the conductive plate or plane of feed network layer 500 and conductive plate or plane 580. The vias 523 define the transmission path 510 through which a transmission signal may propagate. In some examples, the transmission path 510 is used such that a transmission signal is unidirectional; while in other applications, the transmission path 510 may be used for bidirectional signal flow. In this example, the vias 523 are lined with a conductive material (e.g., refer to via 522 of FIG. 7), but alternate examples may fill the entirety of the vias with the conductive material (e.g., refer to via 524 of FIG. 7). The specific construction of the vias 523 is determined by the design, application, build capabilities, cost and so forth. For example, some designs may be difficult to plate and therefore the designer may opt to fill the vias.

Returning to FIG. 7, feed network 501 is a configuration of transmission lines designed to divide the power, and feed the transmission signals to radiating elements, for example, the super elements in another layer. In the present example, a coupling aperture layer 600 (refer to FIG. 10) is positioned proximate the feed network layer 500. The transmission signals may propagate in one or both directions through the feed network layer 500 depending on whether the antenna is used as a transmit antenna, a receive antenna, or both, such as in a time division manner. The transmission paths may be formed in a variety of constructions. As described herein, the transmission paths are formed by a series of vias that define boundaries within which a transmission signal is maintained during propagation.

The vias are generally coupling connectors between layers and, in this example, are conductive holes coupling conductive layers. In some examples, the vias are openings lined with a conductive material, while in others, the vias are filled with conductive material. The conductive coupling forms channels within which the transmission signal propagates. The vias form the boundaries of these channels. The boundaries form the network, such as illustrated by boundaries 502, 504, and 511. Consider a portion of a transmission path, portion 510, where the boundaries are illustrated in bold for clarity of understanding within the feed network layer 500. The transmission path portion 510 (also referred to herein as a transmission line) is defined by a series of vias, such as via 520, and the series of vias are positioned to form the boundary 511. The via 520 is detailed in an enlarged view, along with various constructions. The series of vias defining the transmission path portion 510 are spaced to maintain the electromagnetic transmission signal within the defined boundary. The vias may be any of the configurations illustrated, such as vias 520, 522, 524, 526, and 528, or other configuration. The illustrations provided herein have circular-shaped vias. However, alternate examples may incorporate other shapes, or combinations of shapes, to achieve the desired results, such as to comply with manufacturing tolerances or to create a desired shape of transmission path through the dielectric.

Examples of vias are illustrated as openings formed between layers. The vias may be conductively coated or plated such as via 522, filled with conductive material such as via 524, filled with an alternate material to achieve a desired result such as via 528, and/or open with a small amount of conductive material, such as a trace or conductor, such as via 526. In each example, the vias are designed to maintain guidance of a transmission signal through the bounded area, and the conductive material is used to create a conductive connection between layers and form a waveguide.

Continuing with FIG. 7, at the far right side of the feed network 500 is a final division point 538 creating transmission lines 534 and 536, where each of the divided transmission paths 534, 536 couples to other layers and transmission paths. To ensure impedance matching between the feed network 500 and other portions of the antenna, vias are introduced at specific locations so as to introduce impedance that will balance the reactance of the combination of the feed network 501 and the SE array. These vias are referred to herein as "matching vias" and are beneficial to improve phase control. Matching vias are positioned throughout the feed network 501 and include matching vias 506, 530, 532, positioned within transmission lines.

The feed network layer 500 is positioned between a source of a signal at input 503 and connection segments (such as connection segments 534, 536) to a coupling aperture layer. Matching vias (e.g., vias 506, 530, 532) are also provided for better impedance matching and phase control. Matching via 506 is illustrated at the first division point of feed network 501, and then repeated at each division point. Alternate examples may have matching vias positioned at different locations depending on the design and application. Additionally, some examples incorporate different division schemes, and may not be 1:2, but rather 1:3, and so forth. Matching vias are also positioned within the transmission lines to manage phase control, such as matching vias 532, 534 (enlarged for emphasis in FIG. 7). The matching vias introduce a disruption into a transmission path, and act to alter the impedance of the path. For example, matching via 530, located just after the division point 538, reduces the size of one transmission path.

Figure 9:
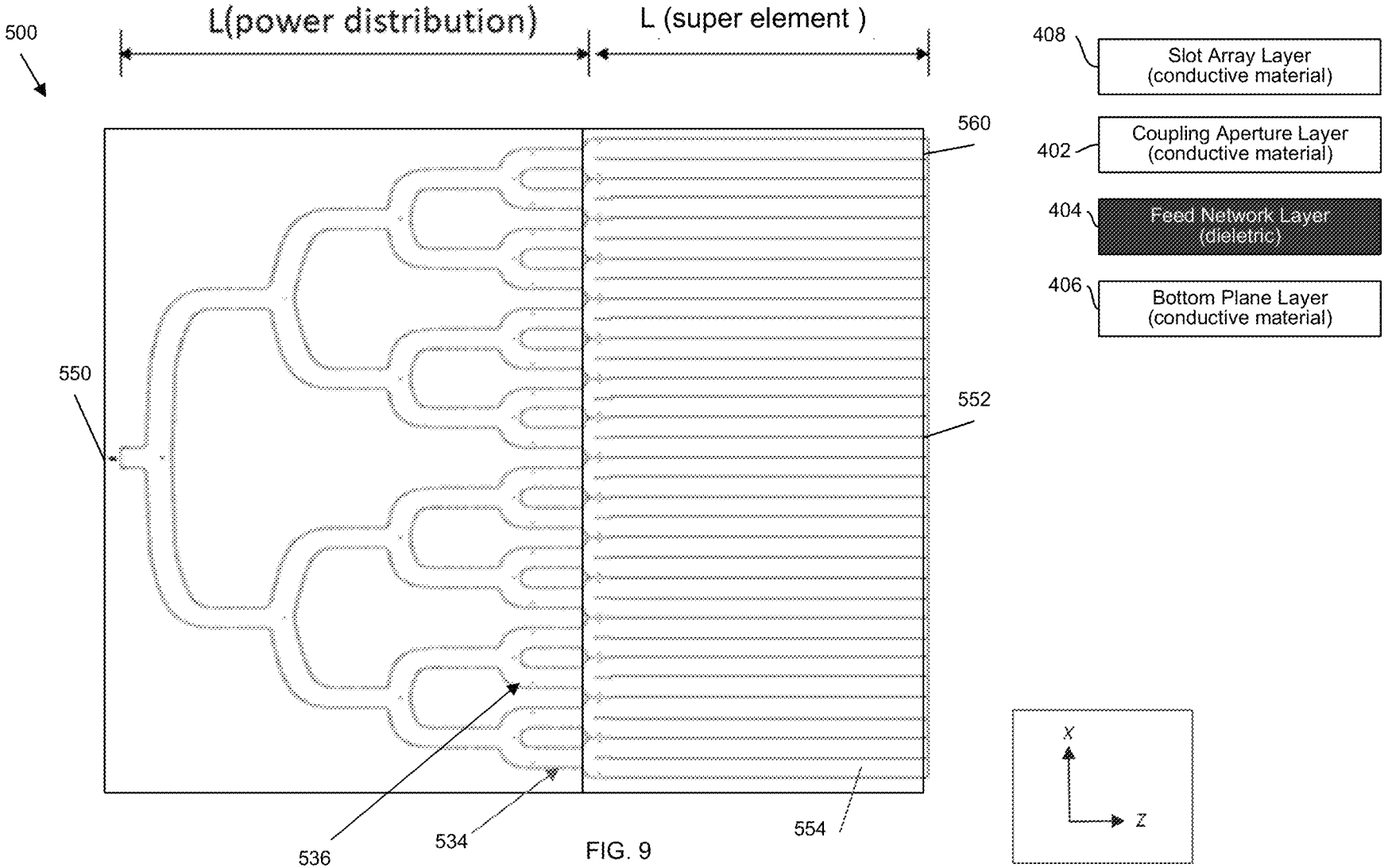
FIG. 9 illustrates the feed network layer of FIG. 7 having super element structures formed on this layer, according to various implementations of the subject technology.

FIG. 9 illustrates the full length of the transmission lines of the feed network layer 500, including transmission paths forming the basis for super element structures 560. The portion 550 includes the power divider network, while the portion 552 includes the transmission line portions forming super element structures 560 from the connection segments and to the edge of portion 552. A super element 554, for example, couples to connection segment 534. A super element, in one example, is defined as a portion of a transmission line bounded by conductive vias. The transmission signal propagates through the super elements 560. The structure of the super elements 560 may incorporate openings allowing a transmission signal to radiate from the super element, and may direct signals to another layer within the device.

Figure 10:
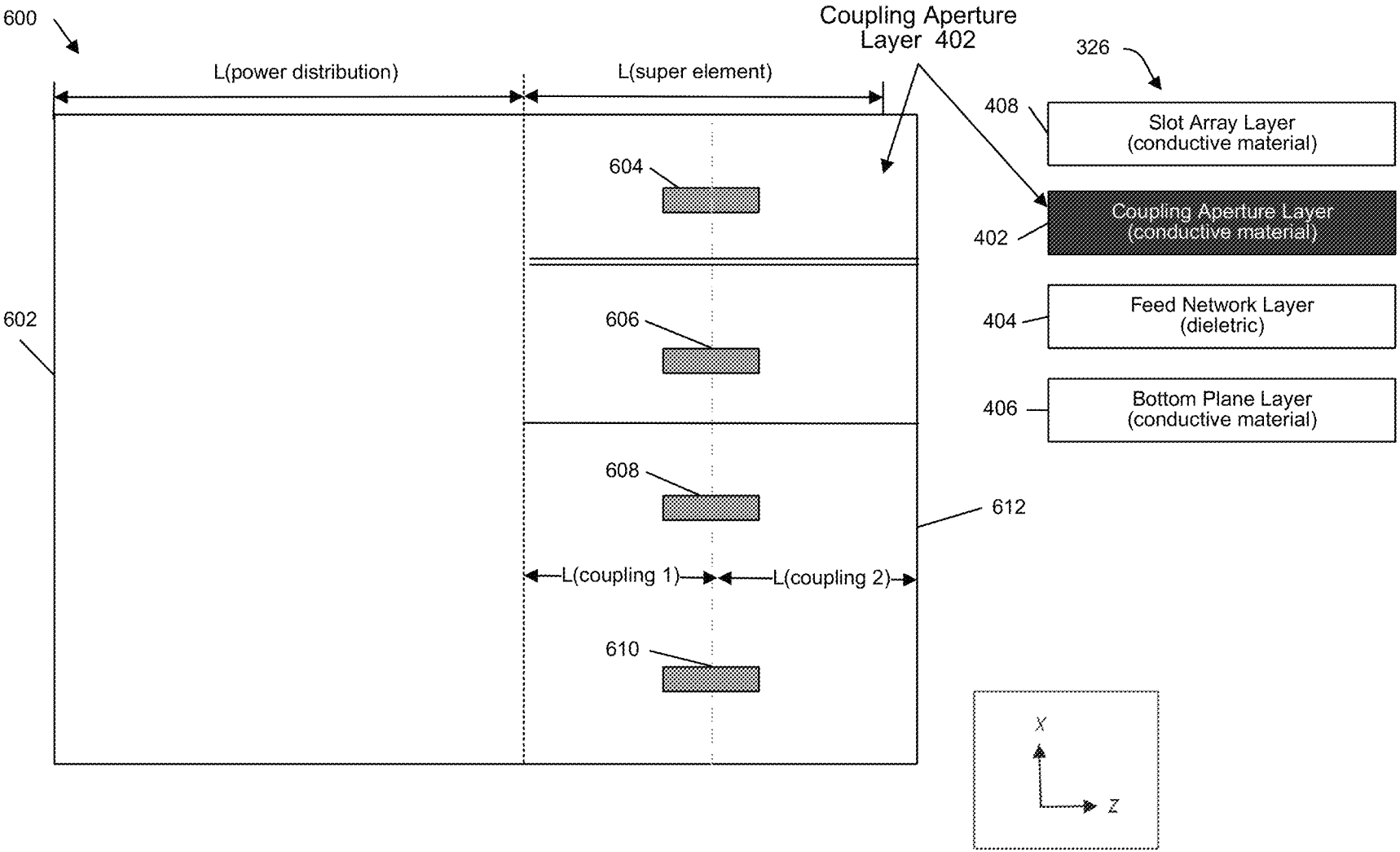
FIGS. 10 and 11 illustrate examples of coupling layers positioned proximate the feed network layer of FIG. 7, according to various implementations of the subject technology.

FIG. 10 illustrates the coupling aperture layer 402 in more detail as an example coupling aperture layer 600. Coupling aperture layer 600 has a plurality of apertures for coupling the signals from a feed network to SEs in an antenna array. The layer stack of antenna array 326 positions the coupling aperture layer 402 between the feed network layer 404 and the slot array layer 408, where the slots of the coupling aperture layer 402 are aligned with SEs of the feed network layer 404 and structures in the slot array layer 408 correspond to the SEs. Layer 600 is a conductive layer having two sections: section 602 and section 612. Section 612 includes the coupling apertures oriented at an angle approximately perpendicular to the centerline of the x direction, while section 602 is a contiguous portion of conductive material. Each coupling aperture (e.g., coupling apertures 604, 606, 608, 610) provides transmission signals to corresponding radiating slots in the SE. The coupling apertures 604, 606, 608, 610 are positioned in approximately the middle of the length (i.e. in the z-direction) of one or more SE.

Figure 11:
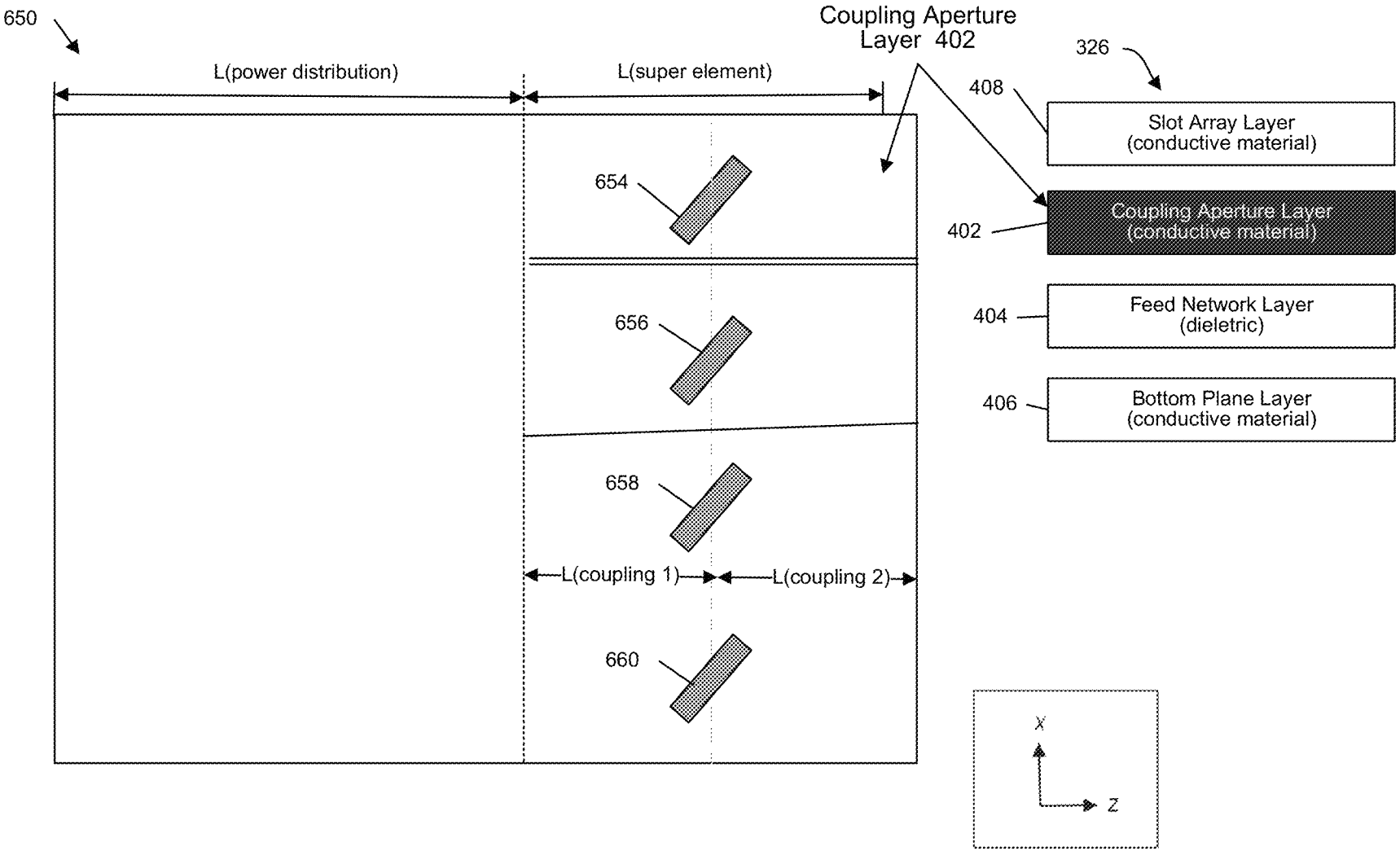

FIG. 11 is an alternate example of the coupling aperture layer 402 where coupling aperture layer 650 is similar to coupling aperture layer 600 of FIG. 10, but with the coupling apertures 654, 656, 658, 660 positioned at an angle to the center line (i.e. in the x-direction). In the illustrated example, coupling apertures 654, 656, 658, 660 are positioned at an approximate 45° angle to the center line. The position of the coupling apertures in the x-direction may be adjusted according to the length from each end of the SEs. This is indicated by L(coupling 1) and L(coupling 2).

Figure 12:
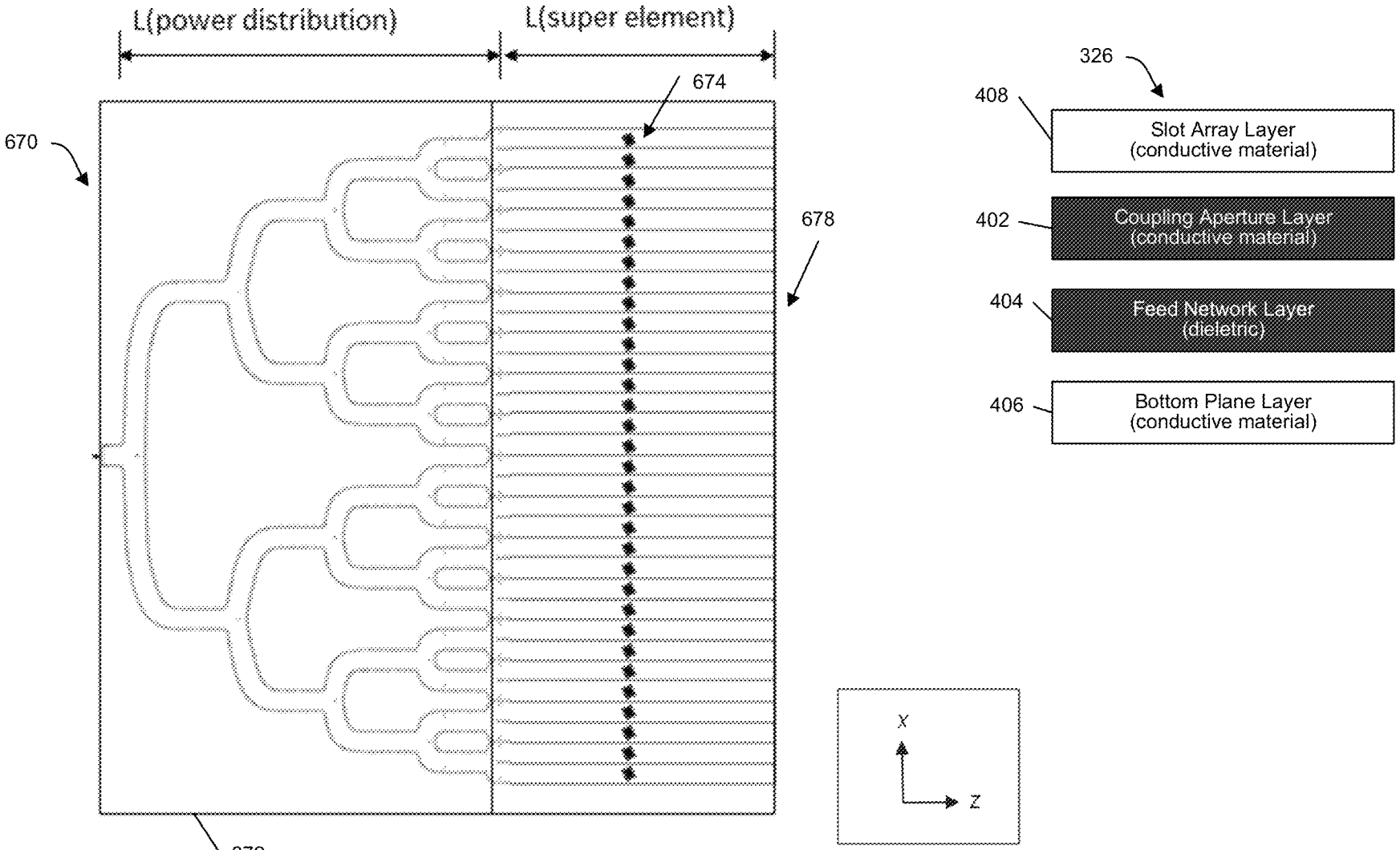
FIG. 12 illustrates an antenna build incorporating a feed network layer and a coupling layer positioned and aligned with respect to the super element structures of the feed network layer of FIG. 9, according to various implementations of the subject technology.

FIG. 12 illustrates a combination 670 of the feed network layer 404 and the coupling aperture layer 402. The illustration shows the placement of the coupling apertures 674 in relation to the position of the SEs 678. In the combination 670, the feed network layer 672 includes thirty-two (32) SEs 678, and there are the same number of coupling apertures 674. Alternate examples may incorporate different number of SEs 678 and may position the coupling apertures 674 in different relations to the SEs 678.

Figure 13:
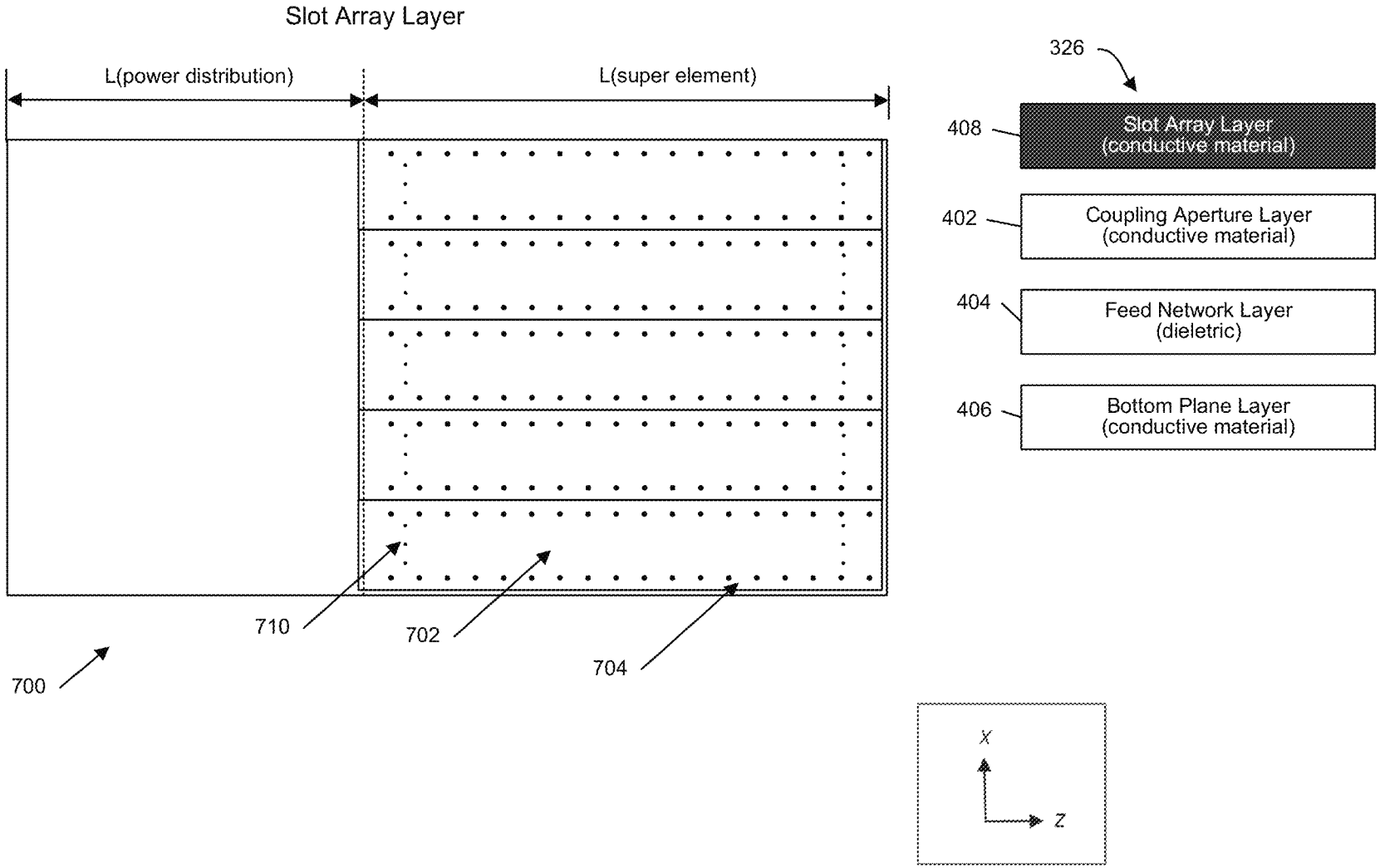
FIG. 13 illustrates a slot layer for use in the antenna layer with vias forming a waveguide, such as in FIG. 8, according to various implementations of the subject technology.

As discussed with respect to FIG. 8, vias provide conductive coupling between different layers of a structure. The SEs are defined in a similar manner by a series of vias to form boundaries within a dielectric material. FIG. 13 illustrates an example of a slot array layer 700 having multiple SEs 702 (configured along the z-direction), bounding vias 704, and at each end of an SE 702, end vias 710. The bounding vias 704 and end vias 710 couple the slot array layer 700 to another conductive layer so that a transmission signal is maintained with the dielectric material positioned between the conductive layers.

Figure 14:
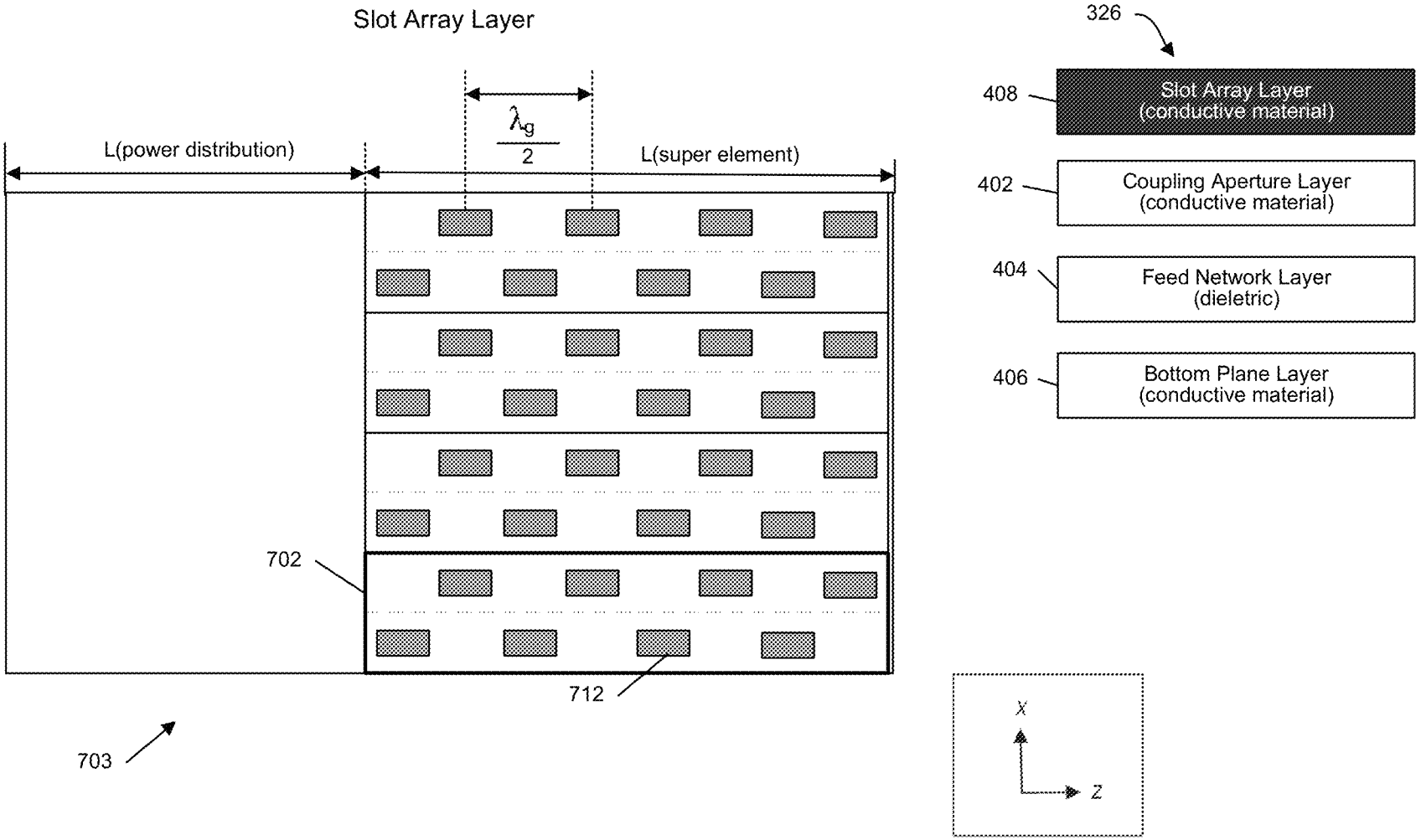
FIG. 14 illustrates placement of discontinuities in super elements of a slot array layer, according to various implementations of the subject technology.

Within each SE is a series of slots or discontinuities through which a signal may radiate. FIG. 14 illustrates a slot array layer 703 having multiple SEs, such as SE 702. Along the length of each SE is a series of rectangular slots 712. In some examples, the distance between SEs is a function of the frequency of signals transmitted through the SEs. For a wavelength of $\lambda g$, corresponding to a frequency of $f=1/\lambda g$, the distance between slots is set at $\lambda g/2$ to maximize the amplitude of the radiated signal and the resultant gain of the device.

FIG. 15 illustrates the combination 700 of the feed network layer 404, coupling aperture layer 402, and slot array layer 408. The bottom plane layer 406 is shown positioned proximate to, or in this perspective below, the feed network 701. The combination 700 illustrates the center position of coupling apertures 704 within the SEs 702. The transmission signal radiates through the coupling apertures 704 along both directions of the SEs 702.

Figure 16:
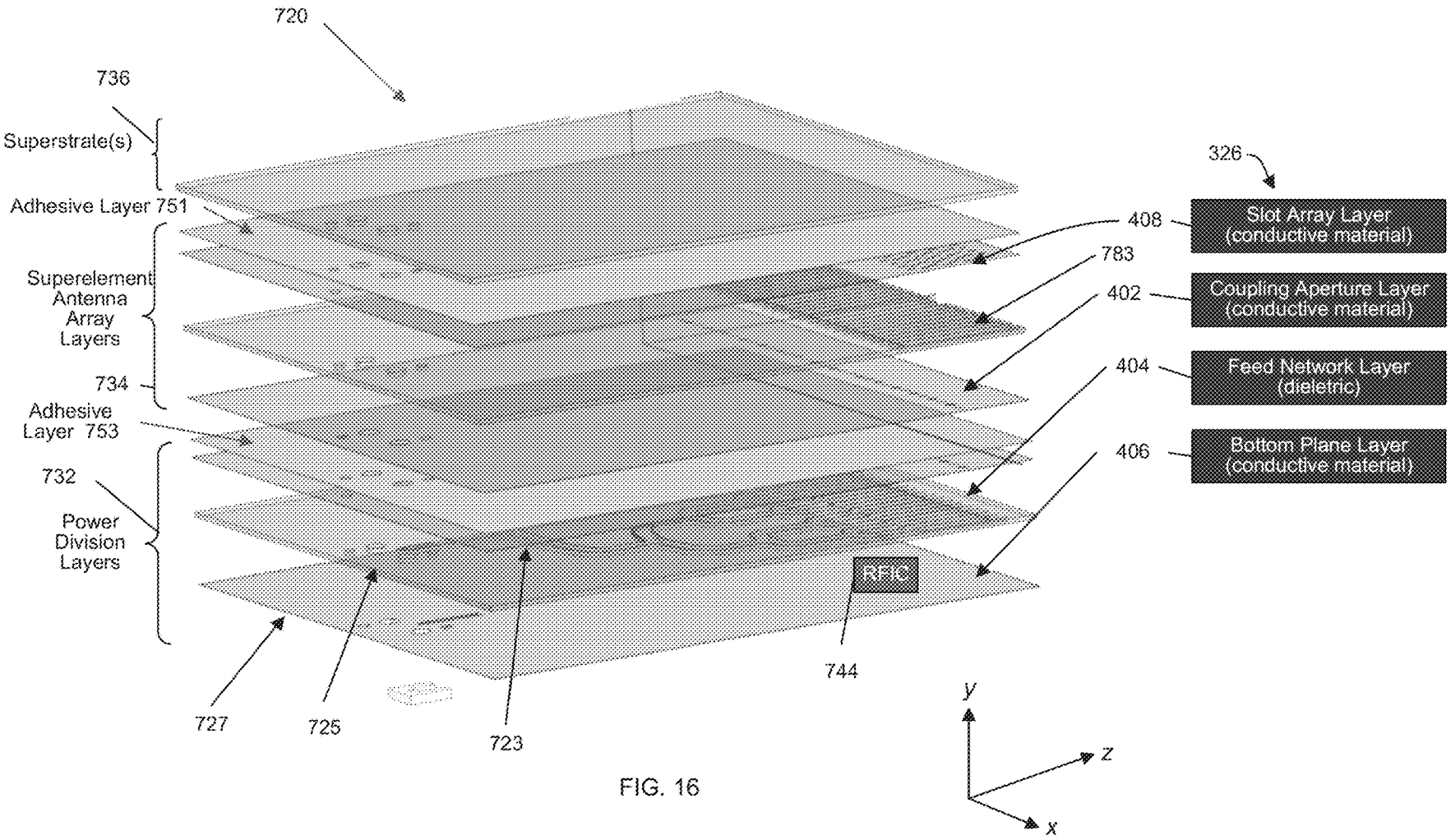
FIG. 16 illustrates a perspective view of a multilayer substrate, according to various implementations of the subject technology.

FIG. 16 illustrates another perspective of a layer stack. The combination 720 includes the bottom plane layer 406, the feed network layer 404, the coupling aperture layer 402, and the slot array layer 408 with intervening dielectric layers, conductive layers, and adhesive layers. This perspective has the shape of the feed network on layer 725 to show the shape of the connections formed by the vias drilled into the dielectric feed network layer 404. The bottom plane layer 406 is illustrated as ground layer 727 of power division layers 732. The power division layers 732 also include the feed network layer 404, having dielectric layer 725 and conductive layer 723. The illustration of FIG. 16 has the layers separated, however, it is understood that the layers are coupled to each other without spacing therebetween. The power division layer 732 forms the feed network layer 404 by connecting the conductive layer 723 and the ground layer 727 by way of vias in the shape of the feed network through the dielectric layer 725. The conductive layers may each be a continuous conductive material, or may each have portions that are conductive and other portions that are not conductive, where the specific design is a function of the application, such as where the dimensions of the device are restricted to a compact size.

The structure of combination 720 has three identified portions, a power division portion comprising the power division layers 732, an antenna array portion comprising the super element antenna array layers 734, and a superstrate portion comprising superstrate layer(s) 736. The combination 720 may be part of an MLMS antenna. Three identified portions are coupled by adhesive layers 751, 753 during the build. In addition, layers of each of the three portions are configured together by the use of adhesive. For example, the power division layers 732 of the power division portion include a bottom layer 406, a feed network layer 404 on a dielectric layer 725, and conductive layer 723, and these layers are configured using an adhesive to maintain the alignment and conductivity and, thus, the feed network paths. The drawing provides context as to construction of the layers. However, it is understood that the dimensions and sizing are not true to scale, as for example, the dielectric layer 725 fills the gap between the feed network layer 404 and the bottom plane layer 406 allowing for transmission signals to travel through the dielectric material. This illustration is intended to show the layer positions. For example, a dielectric layer, such as layer 725, and a conductive layer, such as layer 404, may each be 20 mils thick (or 0.0245 millimeters ("mm") thick). For the actual build, there are adhesive layers and other materials to build the combination 720 of layers. For example, the adhesive layers 751, 753 may each be approximately 1 to 3 mils thick.

In the present example, the SE antenna array layers 734 include the slot array layer 408 and the coupling aperture layer 402. The slot antenna layer 408 is proximate to the SE outline layer 783, which is proximate to the coupling aperture layer 402. There may be other layers and materials between each of these layers to improve performance and/or manufacturability.

Continuing with FIG. 16, a superstrate layer(s) 736 is positioned proximate to the slot array layer 408, and receives the radiated signals from the slot array layer 408. The superstrate layer(s) 736, in some examples, is a dielectric layer that acts as a transition for the signal between the conductive slot array layer 408 to the air.

In some examples, an RFIC provides reactance control of the radiation pattern from the antenna. By controlling or changing the reactance, such as capacitance, the device may perform phase-shifting and beam steering of the antenna. The RFIC 744 may include a varactor, a set of varactors, a phase shift network, a vector modulator architecture, or other mechanisms. There could be multiple RFICs embedded into the ground plane (e.g., bottom plane layer 406), such as to correspond to the number of levels in the feed network layer 404 or SEs of the slot array layer 408.

Figure 17:
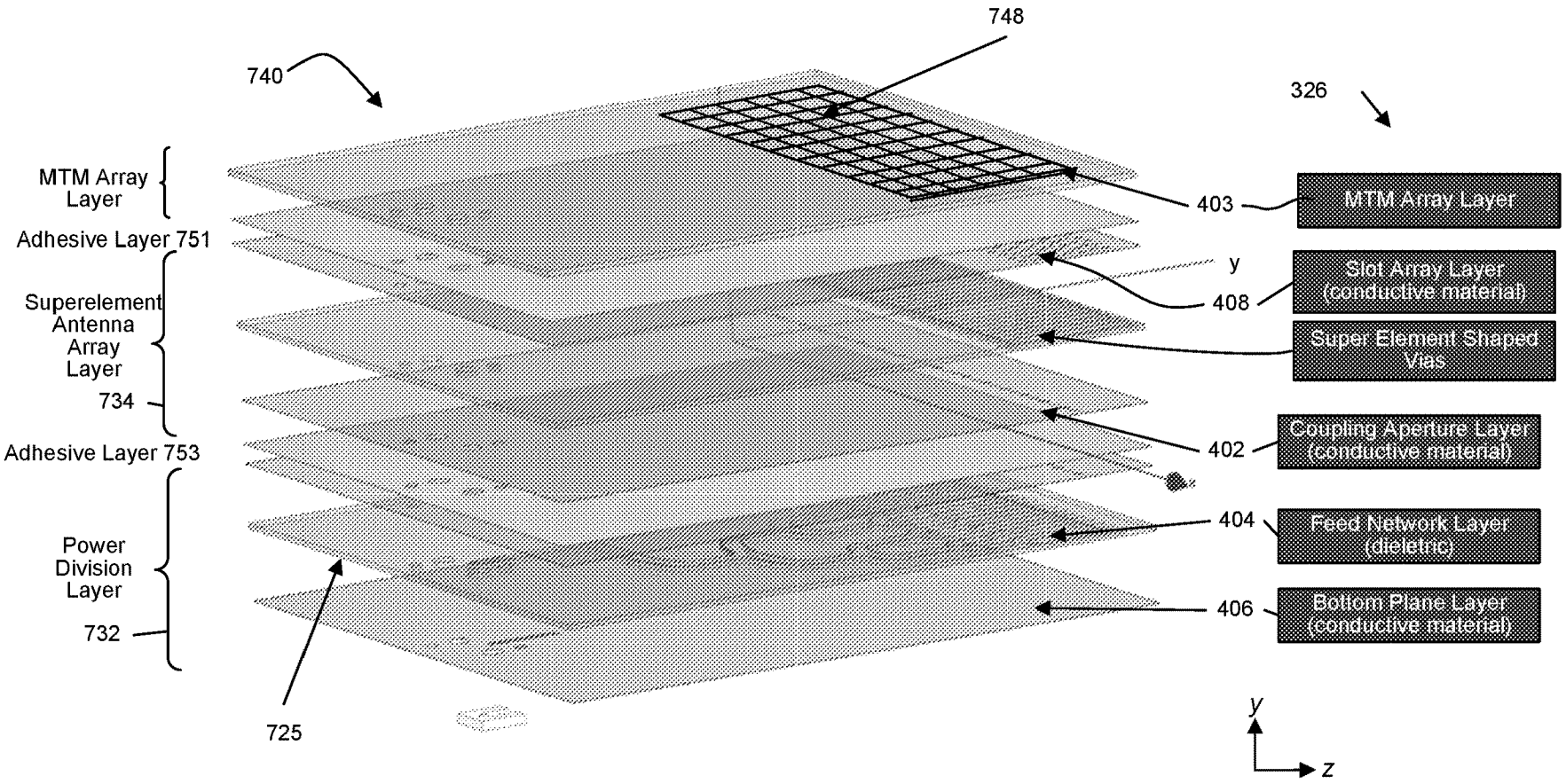
FIG. 17 illustrates a perspective view of a multilayer substrate having a metamaterial array layer, according to various implementations of the subject technology.

FIG. 17 illustrates a combination 740 having layers and a configuration similar to that of combination 720 of FIG. 16 with the addition of an MTM array layer 403 proximate to the slot array layer 408, where the MTM array layer 403 is configured to receive the radiated signal from the slot array layer 408 and retransmit the signal. The MTM array layer 403 has an array of metamaterial cells that replaces the superstrate layer(s) 736 of combination 720 of FIG. 16. Each MTM cell (e.g., MTM cell 748) has a reactance control mechanism (not shown) that enables the MTM cell to radiate an RF signal with a given phase. The reactance control mechanism may be in the form of a varactor or a set of varactors. In some examples, the MTM array layer 403 is positioned between the slot array layer 408 and the superstrate layer(s) 736 (refer to FIG. 17).

Figure 18A:
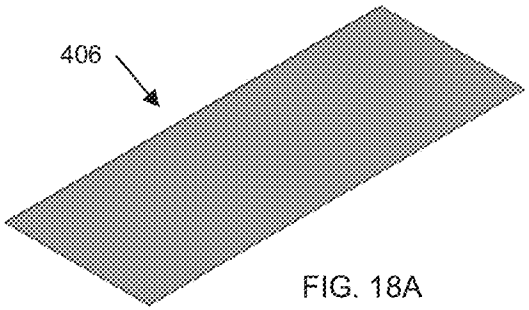
FIGS. 18A, 18B, 18C, 18D, 19A, and 19B illustrate construction of a portion of a multilayer substrate having a feed network layer configured between conductive layers forming a waveguide within a dielectric layer, according to various implementations of the subject technology.
Figure 18B:
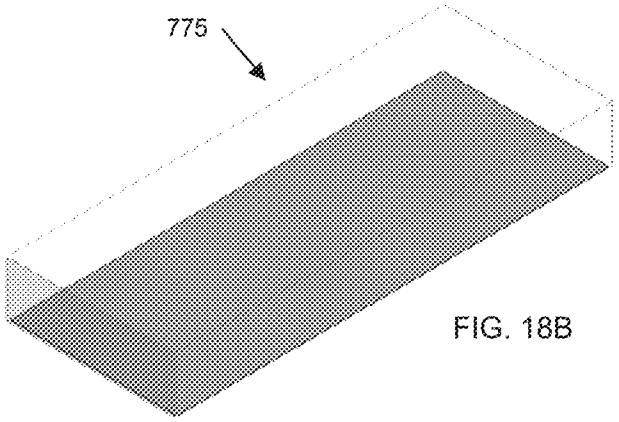
Figure 18C:
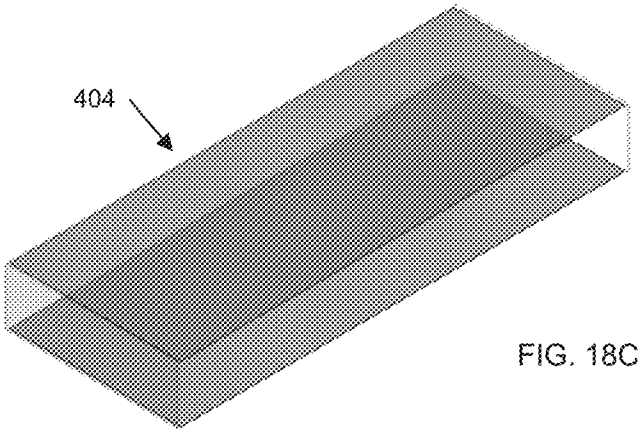
Figure 18D:
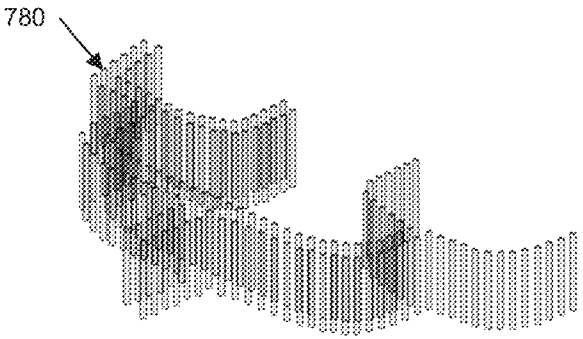
Figure 19B:
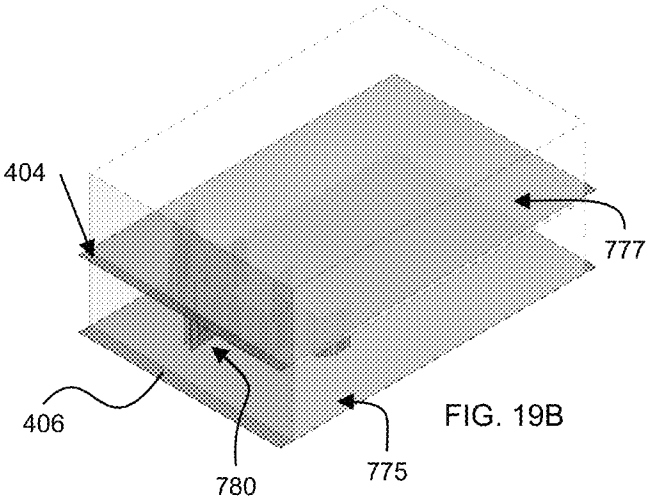
Figure 19A:
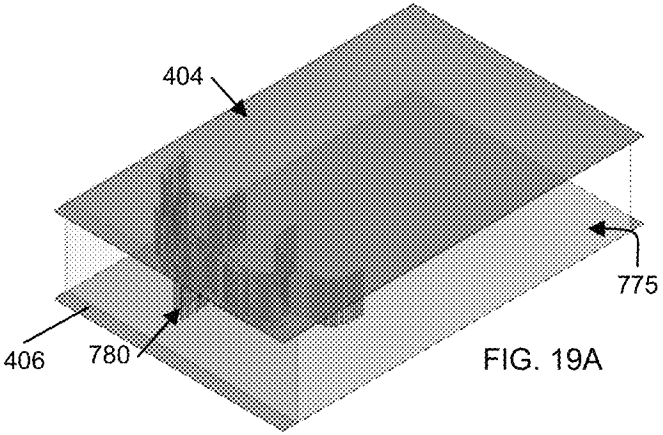

FIGS. 18A, 18B, 18C, 18D, 19A, and 19B illustrate the individual components of the layers in more detail, and in a construction process order. Note that multiple steps may be performed to form the MLMS antenna. The base layer 406, shown in FIG. 18A, is a conductive layer that acts as a ground or reference plane for the structure. A dielectric layer 775 shown in FIG. 18B, similar to layer 725 of FIGS. 16 and 17, is positioned proximate to the base layer 406 of FIG. 18A and coupled thereto. The feed network layer 404 shown in FIG. 18C, a conductive layer, is then coupled thereto. Vias 780, shown in FIG. 18D, form the shape of the feed network, and a portion is illustrated. The vias 780, as shown in FIG. 19A, conductively couple the feed network layer 404 to the base layer 406. Another dielectric layer 777, shown in FIG. 19B, is positioned proximate to the feed network layer 404. Additional layers are added in similar manner to build up the entire combination for a device.

As described in the illustrated example, the layers of the MLMS antenna have the same orientation with respect to other layers in the MLMS antenna. In other examples the feed network layer may be orthogonal to the slot array layer or other layers. Other angular orientations between the layers in an MLMS antenna array can also be implemented depending on the design criteria and desired antenna parameters and specifications.

Different types of vias may be implemented depending on function, location, and layer make-up. The vias are used to define transmission paths, to change impedance, and to otherwise change the characteristics and behavior of the antenna. There could be any number of SEs in an antenna design depending on the implementation, such as eight, sixteen, thirty-two, and so on. The number of SEs in the antenna, the number of levels in the feed network layer, and the number of coupling apertures define the function and operation of the antenna.

Figure 20:
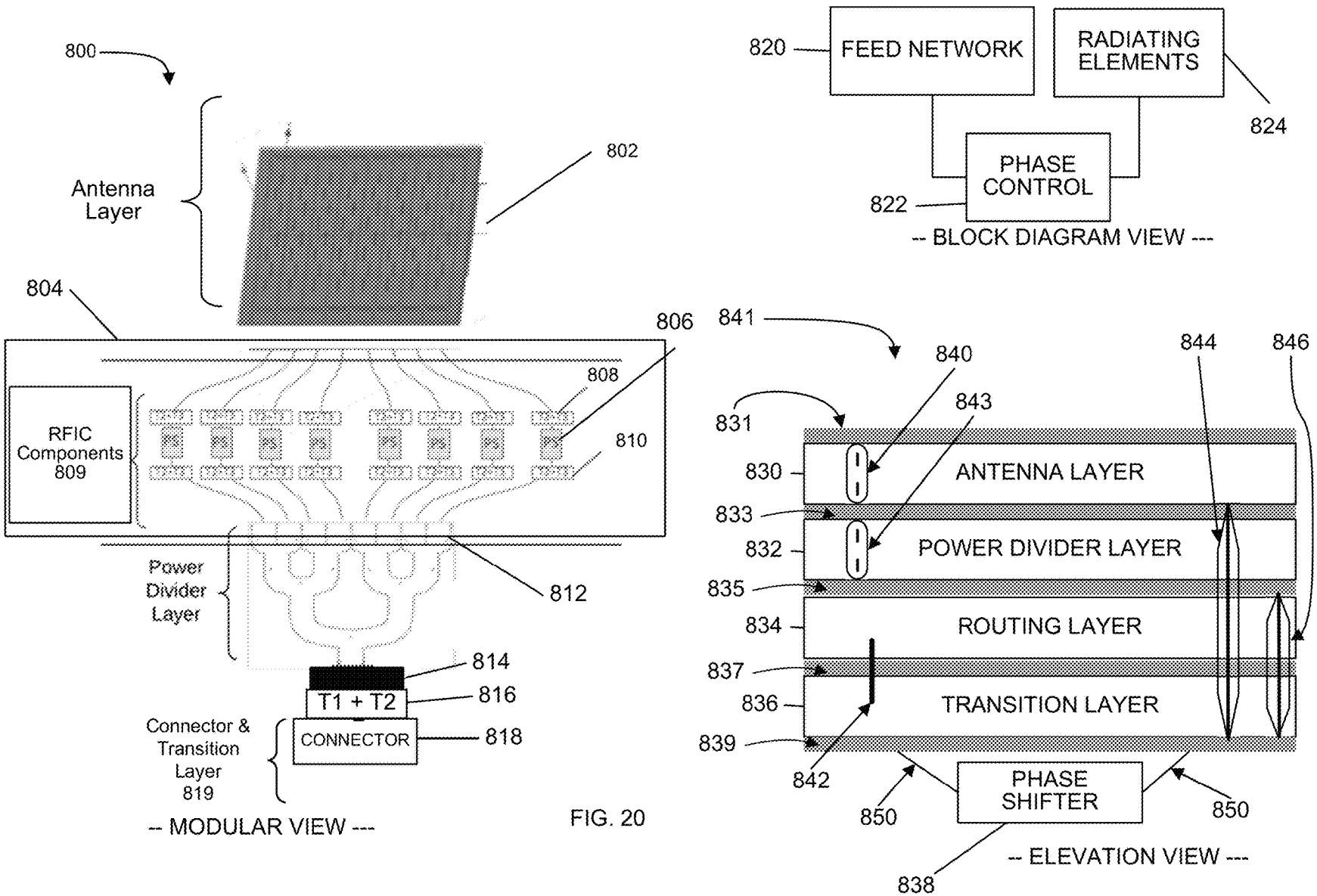
FIG. 20 illustrates views of an antenna system including a feed network, radiating elements, and phase control, according to various implementations of the subject technology.

As illustrated herein, the antenna comprises multiple layers with coupling therebetween, and effects a specific function with capability to control the antenna. FIG. 20 illustrates a modular view, a block diagram view, and an elevation view of an antenna system 800. The antenna layer 802 has eight SEs, which act as slotted waveguides. Each SE of slot array layer 802 is coupled to a circuit in RFIC layer 804, where phase control modules 806, which are connected to transitions 808 and 810, are provided for each path. The paths then continue to the power divider layer 812, which is a feed network layer. The power divider layer 812 is then coupled to a power component 814, which comprises a power amplifier ("PA") for the transmit operation and a low noise amplifier ("LNA") for the receive operation.

A connector and transition layer 819 includes the one or more transitions 816 (e.g., shown as T1+T2 in FIG. 20) to couple different portions of the device 800. There are various transitions 816, 808, 810 between layers that may be used to implement the RFIC components 809 and/or the power components 814. The transitions may be implemented as transition 816, 808, 810 and may be located at other places in the design. A connector 818 enables the device 800 to interface with other modules in a detection system or a communication system. In an autonomous vehicle, the connector 818 may be connected to a sensor fusion module, and so forth.

The functions of device 800 are illustrated in block diagram form as feed network 820, radiating elements 824, and phase control 822. The phase control circuit may be implemented within each of these modules and/or may be implemented between them. The different layers making up the device 800 include a variety of structures, formats, and materials. To have the different layers coupled together and functional often requires transition elements, such as to maintain impedance matching or to reduce insertion loss. To implement the phase control 822 and to connect portions of the device 800, there are several transition points.

One example is device 841, which has an antenna layer 830 with vias 840 to form the antenna SEs. The vias 840 couple conductive layer 831 to conductive layer 833 through antenna layer 830, which is a dielectric layer. Other vias 843 are provided between conductive layers 833 and 835, between which a power divider layer 832 is positioned. The vias 840, 843 form transmission paths through conductive layers 831, 833, 835. This example also implements a transition 842 in transition layer 836 which is coupled to routing layer 834, where a signal is routed to achieve a desired circuitry. A conductive layer 837 lies between the transition layer 836 and the routing layer 834. A phase shifter 838 is coupled to other portions of the device 841 through the transition layer 836. The phase shifter 838 couples to device 841 through connections 850. There are also other transitions between layers, such as connection 844 between conductive layer 833 and conductive layer 839, and connection 846 between conductive layer 835 and conductive layer 839. Each of these connections, couplings, or associations may require transitions. These examples are illustrated to explain the transition mechanisms, structures, and designs available in multi-layer devices, but are not limiting, as these methods and apparatuses described herein are applicable in other applications and with other materials, configurations, and combinations.

Figure 21:
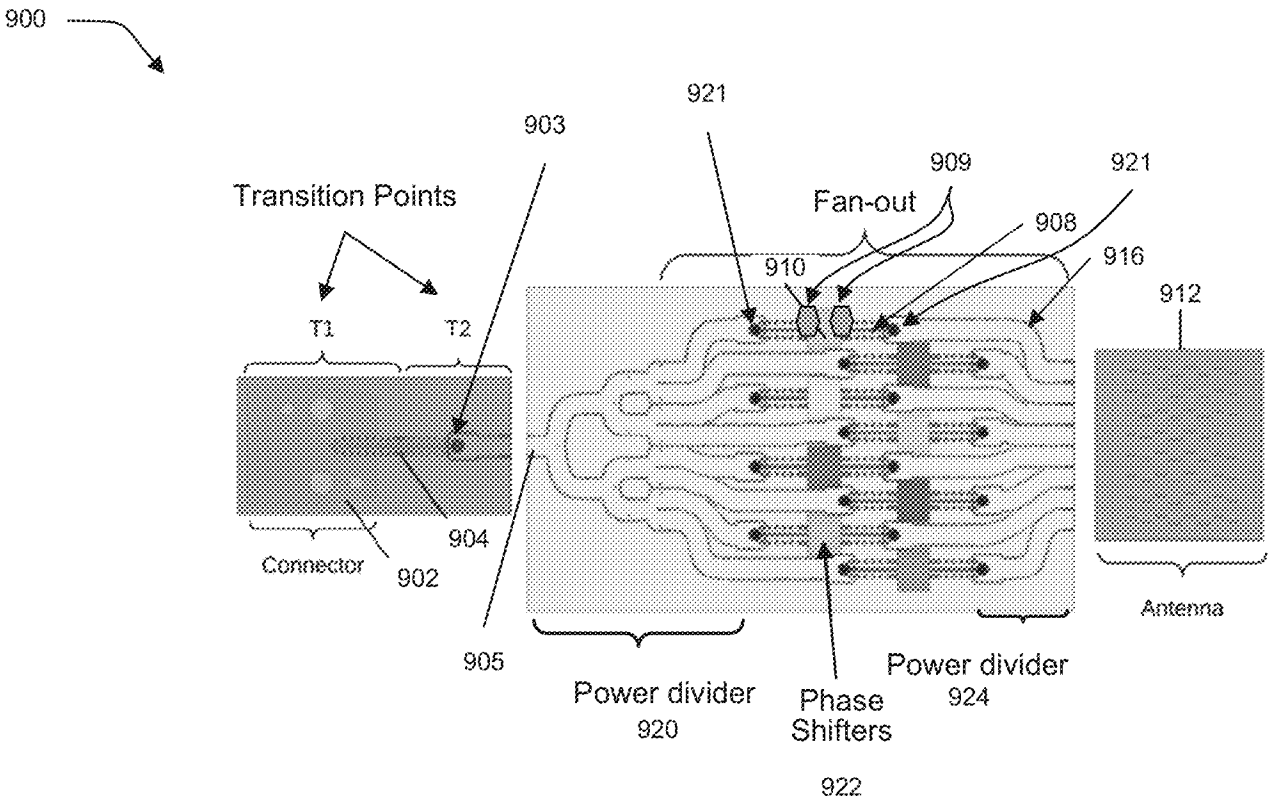
FIG. 21 is a planar view of an antenna system, such as that of FIG. 20, according to various implementations of the subject technology.

FIG. 21 is a layout for a device 900 having various portions and connections similar to those described hereinabove for an antenna structure with power dividers 920 and 924 with phase shifters 922 positioned therebetween. The power divider 924 couples with antenna 912. The design of device 900 is referred to as a fan-out structure, as there is a single input at connector 902, which may include different structures, such as a coplanar waveguide ("CPW"), substrate integrated waveguide ("SIW"), and so forth. At the interface locations, a transition mechanism may be required. There are transition points where the phase shifters 922 couple to the power dividers 920, 924. In such a structure, as device 900, there are multiple types of conductive paths, including through coplanar waveguides, substrate integrated waveguides, and so forth. Waveguides have a variety of possible shapes, including uniform, rectangular, circular, ridged, and so forth. A variety of applications utilize waveguides. The methods and apparatuses disclosed herein are described with respect to microwave waveguides. Note that herein the terms "transmission line" and "waveguide" are used generally to refer to a conductive path; they may be one or multiple conductor structures. In some applications, there are losses introduced by the use of the waveguide and its interaction with other parts of a device.

A mismatch loss in an SIW may have a mismatch loss that is a function of the power delivered and the power available. These losses interfere with proper and efficient operation of a microwave device and increase power consumption. The device 900 illustrates an interface between a CPW 904 and an SIW 905 at transition point 903. There are also transitions between pathways in the device 900 to incorporate components, including active components. For example, the phase shifter 910 is an external component that is not part of the substrate layers of device 900. The phase shifter 910 is connected to a portion of the power dividers 920, 924. The phase shifters 922 are connected through wire bonding or other connection mechanism, at points such as connection points 909. There is a transition from coplanar portion 908 to SIW portion 916 at transition 921. In each of the transitions, including transition points T1 and T2 in FIG. 21, there is an insertion loss and other negatives. As the size of the components and paths of a device increase, these losses become unacceptable. Transition mechanisms of the disclosed various examples provide mechanisms to reduce these losses.

Figure 22:
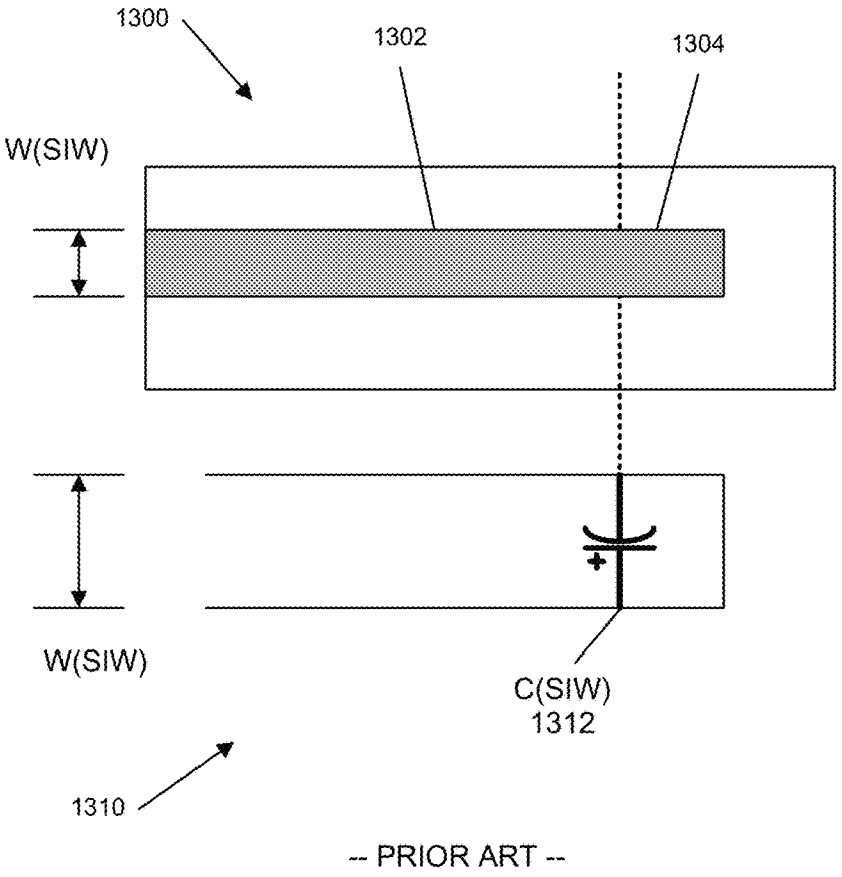
FIG. 22 illustrates a prior art transition to a substrate integrated waveguide.

FIG. 22 illustrates a prior art portion of a multilayer substrate 1300. A connection is made from another layer (not shown) to the illustrated planar portion of substrate 1300 having a transmission line, or waveguide, integrated within the substrate 1300. This structure is referred to as a substrate integrated waveguide, or SIW. The SIW illustrated has two sections identified. A first SIW portion 1302 extends along the plane as illustrated. A second SIW portion 1304 is the planar area having connection to another layer of the substrate 1300. The first SIW portion 1302 and the second SIW portion 1304 have a same width of W(SIW). This is the width of the transmission line, or waveguide. A circuit diagram of the portion of substrate 1300 is represented by the circuit 1310 having a capacitance 1312, identified as C(SIW). The capacitance 1312 may also represent other reactive and resistive components that are introduced when a connection is made to the waveguide at the second SIW portion 1304. As with all the figures, these drawings are not necessarily drawn to scale, but rather are meant for clarity of understanding of the reader.

Multilayer substrates often have circuits, transmission paths, conductive paths, traces, and so forth coupled between layers. This is done for a variety of purposes, including to reduce the overall size and footprint of a device, to reduce interference between different portions, to improve performance of a device, to reduce cost of a device, to improve manufacturability, and so forth. The capacitance 1312 presents issues as it introduces, unwanted reactance that creates losses and may have other artifacts that disrupt operation of a device. There is a need to offset or cancel the capacitance 1312. This capacitance 1312 may be referred to as a transition capacitive impedance.

In some examples, a transition element ("TE") is introduced that provides a change in the SIW width to act as an inductive component and cancel the transition capacitive impedance, such as capacitance 1312. This avoids, or reduces, insertion loss, and increases the bandwidth of operation. This improvement in return loss increases the performance of the device.

Figure 23:
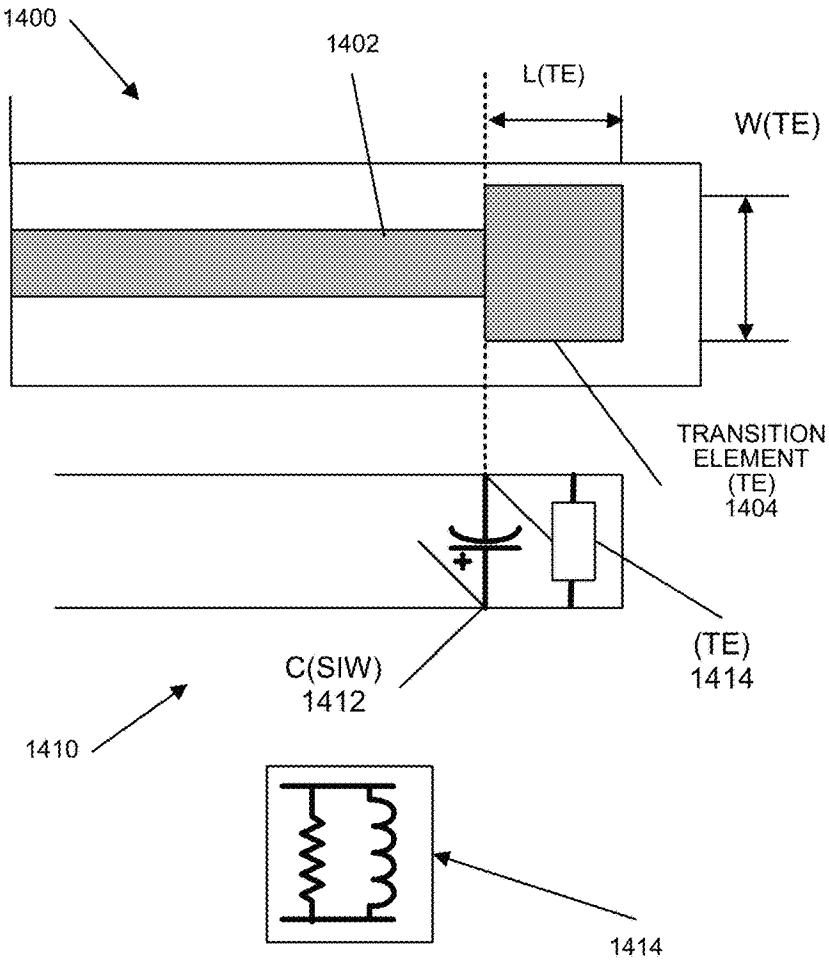
FIG. 23 illustrates a transition element to a substrate integrated waveguide, according to various implementations of the subject technology.

As illustrated in FIG. 23, a transition element (TES 1404 is implemented in the portion of multilayer substrate 1400. TE 1404 is positioned at an end of SIW portion 1402, where a connector from another layer of the substrate meets to complete a transmission path. TE 1404 has a length in the horizontal direction of L(TE), and a width in the vertical direction of W(TE) as shown in FIG. 23. An equivalent circuit 1410 is illustrated; TE 1414 is positioned in parallel with the capacitive portion C(SIW) 1412. In some examples, the TE 1414 is a resistive element in parallel with an inductive element. The reactance of TE 1414 counters the capacitive element 1412.

Figure 24:
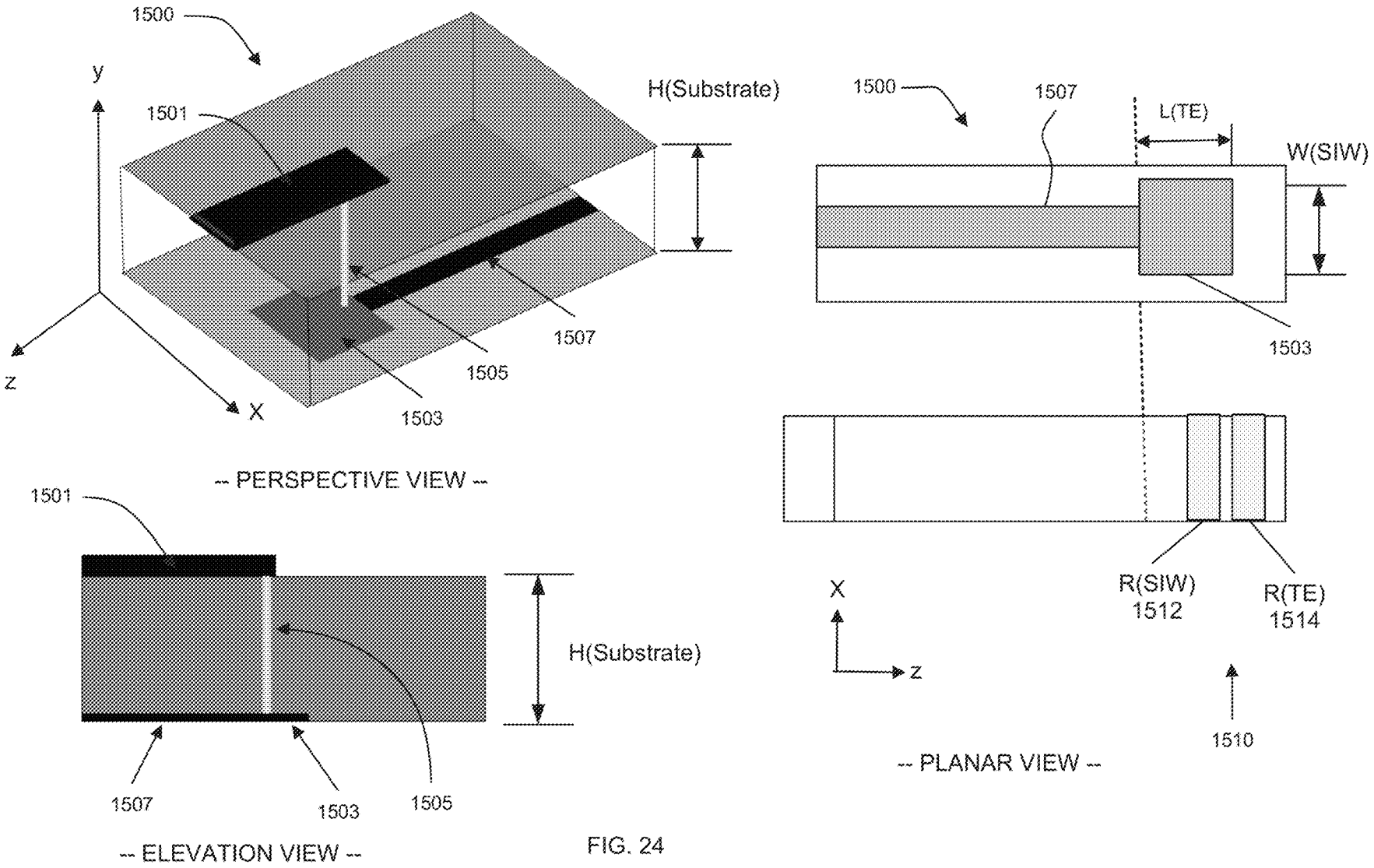
FIG. 24 illustrates views of a multilayer substrate having connection between layers to connect a transmission path having a transition element, according to various implementations of the subject technology.

FIG. 24 is a perspective view of a multilayer substrate 1500 having CPW 1501 positioned on a planar surface and connected to TE 1503 by way of conductor 1505. TE 1503 is coupled to SIW 1507. The substrate has a height in the y-direction of H(Substrate). The design and sizing of the CPW 1501 and SIW 1507 are a function of the frequency of operation, the desired bandwidth, the construction and configuration of the transmission line through the multiple layers, and the height of the substrate. There may be other considerations that are required to achieve a desired result. Given these constraints, the design of a TE 1503 is sized with respect to the width of the SIW 1507. The elevation view of the substrate 1500 illustrates the configuration of the various components and the height, H(Substrate).

A planar view of the SIW 1507 is illustrated, where TE 1503 has a width, W(SIW). The equivalent circuit 1510 has a reactance portion R(SIW) 1512 corresponding to the SIW 1507, and a reactance portion R(TE) 1514 to compensate for the reactance 1512. The TE 1503 is sized and configured to be different from the dimensions of the SIW 1507, and the TE 1503 is a function of the various constraints of the transmission line and substrate design. In this example, the width dimension of the TE 1503 is greater than that of the width of SIW 1507. The size and shape of the TE may take a variety of forms. In some examples, the combination of a TE coupled to a conductor is referred to as a transition.

Figure 25:
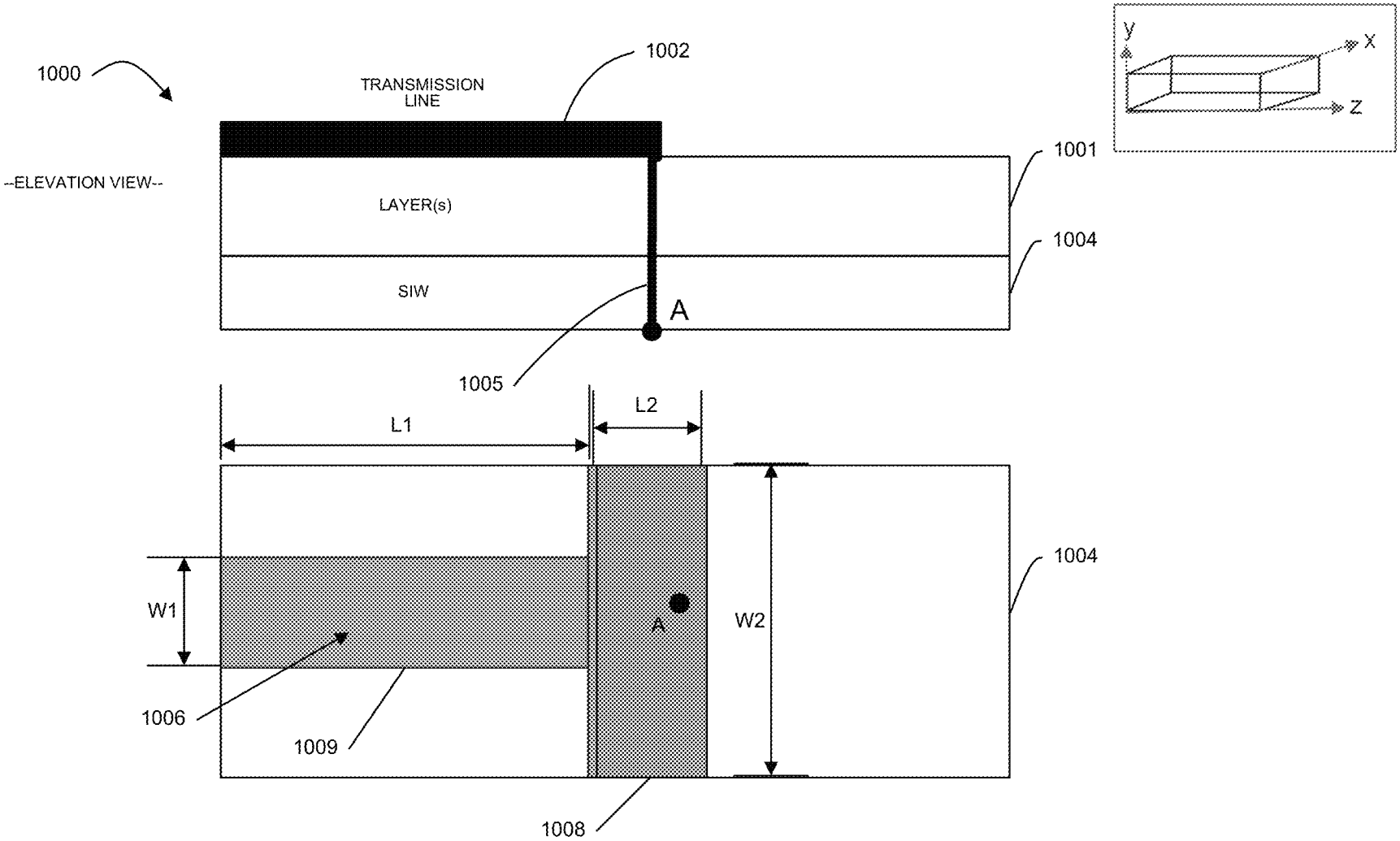
FIG. 25 illustrates a transition element in a multilayer substrate, according to various implementations of the subject technology.
Figure 26:
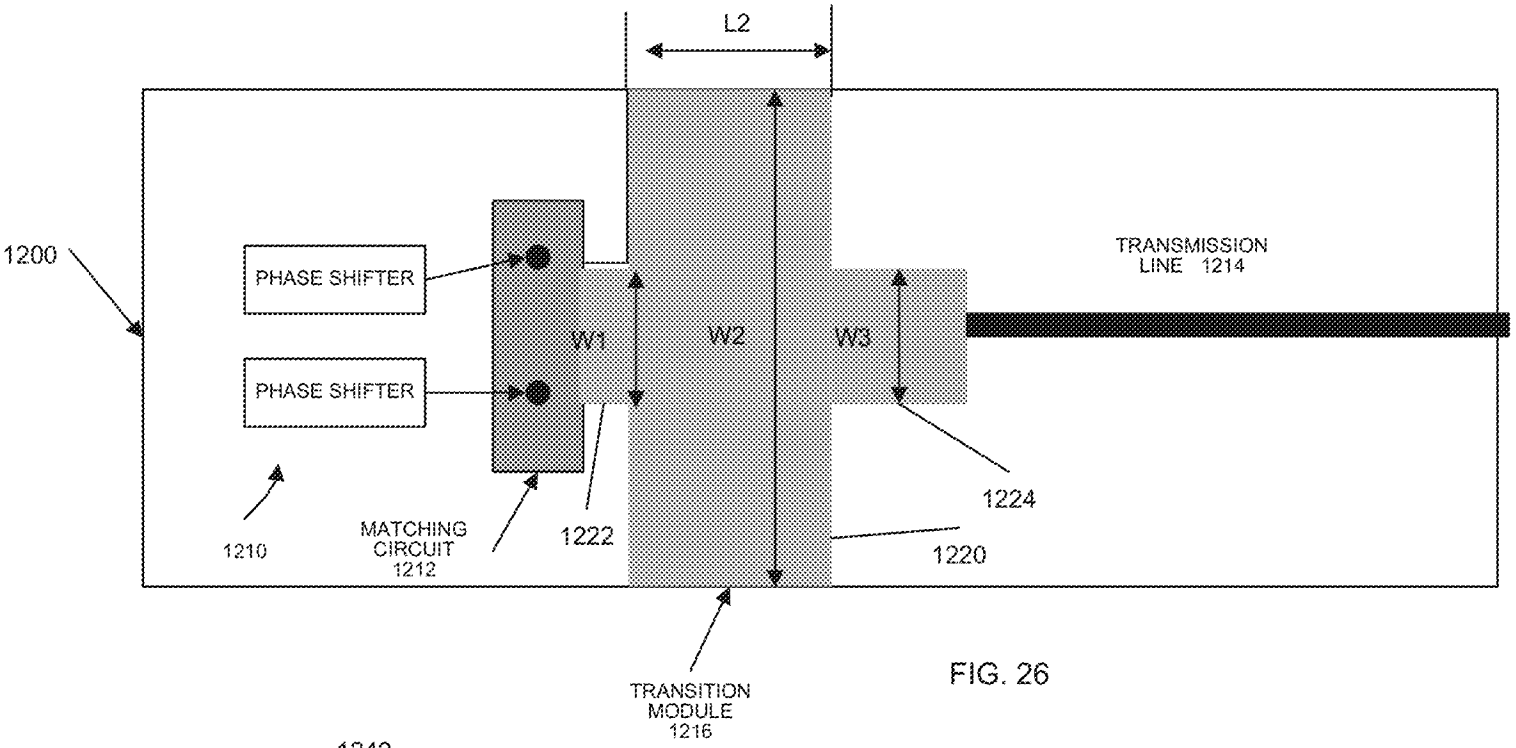
FIG. 26 illustrates a transmission element in a system, according to various implementations of the subject technology.
Figure 27:
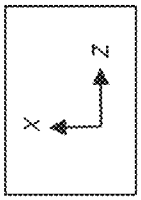
FIG. 27 illustrates a transition configuration, according to various implementations of the subject technology.
Figure 27:
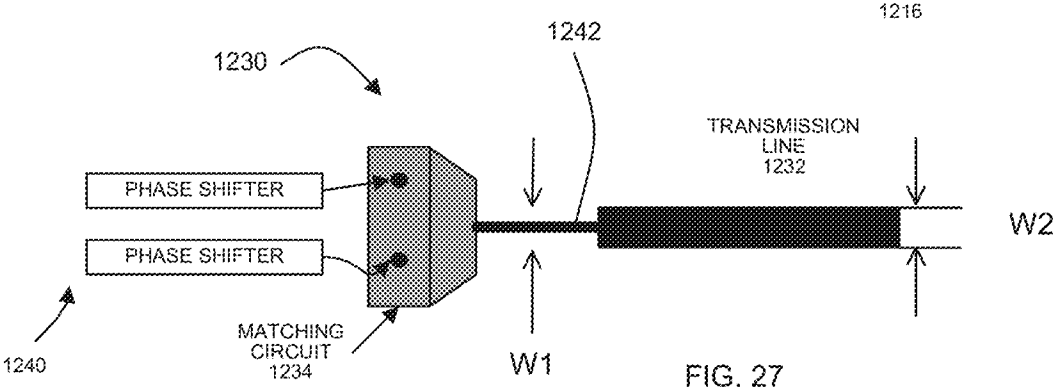

Examples of transition mechanisms are illustrated in FIGS. 25, 26, and 27, where conductive surfaces are arranged to remove, avoid, or absorb insertion loss and provide a smooth transition between layers and path types. These transition mechanisms provide a transitional impedance between the two paths. For example, in FIG. 25, the layered device 1000 includes layer(s) 1001, such as a multilayer device described herein, and other devices built with multiple layers to accommodate the transmission paths and circuitry. The transmission line 1002 is coupled by a conductor 1005 through the intervening layers 1001 to SIW layer 1004. In some examples, the transmission line 1002 has the same width as the SIW layer 1004. The transmission path then continues as conductive area 1006. The shape of the conductive area 1006 is determined by the application and configuration, while in this example the length of conductive portion 1009, that is L1, is longer than the length of conductive portion 1008, that is L2, and is a transitional impedance that reduces the impact of transitioning between CPW and SIW.

The transition mechanism 1000 enables a coplanar transmission line to couple to a different layer, or layers, of a multi-layer device, as those described herein. The connection is a transition from CPW to SIW at point A. This may be applicable at the transition point 903, of FIG. 21, for example. A transmission line 1002, such as a conductive trace coupled to another point, such as point A, may be applicable on another layer. Here the transmission line 1002 continues from one side of layer 1001 to the other side of layer 1004 via conductor 1005. From the bottom view, the transmission line is coupled to point A on the structure 1006 having a T-shaped conductive area 1006. The conductive portion 1008 has a width in the x-direction of W2, which is greater than the width of conductive portion 1009, which is W1. This configuration provides reduced insertion loss with minimal impact to the manufacturability of the multi-layer device 1000 by implementation of the hammer head shaped conductive portion.

FIG. 26 illustrates a portion of a multi-layered device 1200 having a phase shifter to a multi-layer stack. The phase shifter is not built into the layers of the stack. In this example, phase shifters 1210 are coupled to a matching circuit 1212. A transition module 1216 is coupled to a transmission line 1214 and to the matching circuit 1212. The transition module 1216 has multiple conductive portions, where at least one of the conductive portions has a greater width in the x-direction. Here the conductive portion 1220 has a greater width than conductive portions 1222 and 1224. The width of conductive portion 1216 is W2 in the x-direction, which is larger than the width of the conductive portions 1222 and 1224, which are W1 and W3, respectively. The length of the transition module 1216 is L2 in the z-direction. These are designed to introduce a transition inductance.

FIG. 27 illustrates another transition design 1230 having phase shifters 1240 coupled to a matching circuit 1234 for coupling with transmission line 1232. The transition element 1242 is positioned between the transmission line 1232 and the matching circuit 1234. The dimensions of the transition element 1242 are less than those of the transmission line 1232. The transmission line 1232 has a width of W2 greater than the width W1 of transition element 1242. This again reduces losses on the transition from the external elements, phase shifters 1240, and the transmission line 1232.

Figure 28:
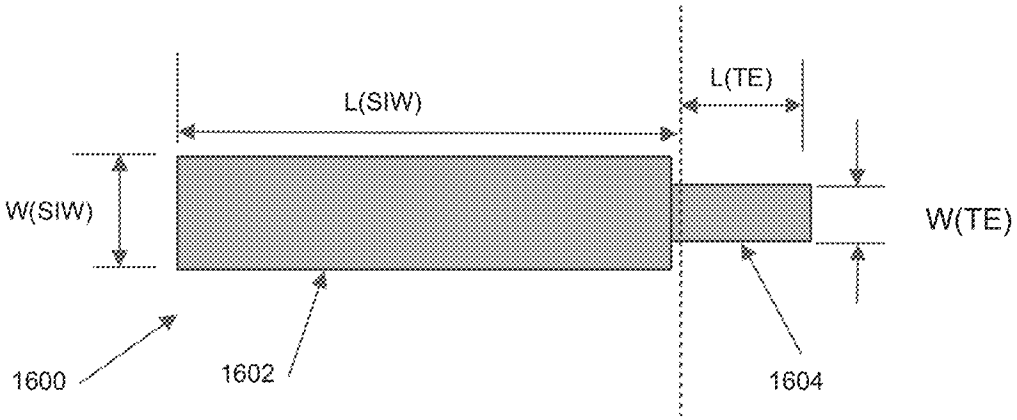
FIGS. 28 and 29 illustrate transition elements, according to various implementations of the subject technology.

FIG. 28 illustrates an example of a transmission line 1600 having SIW 1602 and TE 1604, having widths W(SIW) and W(TE) and lengths L(SIW) and L(TE), respectively. In this example, the width dimension of the TE 1604 is less than W(SIW).

Figure 29:
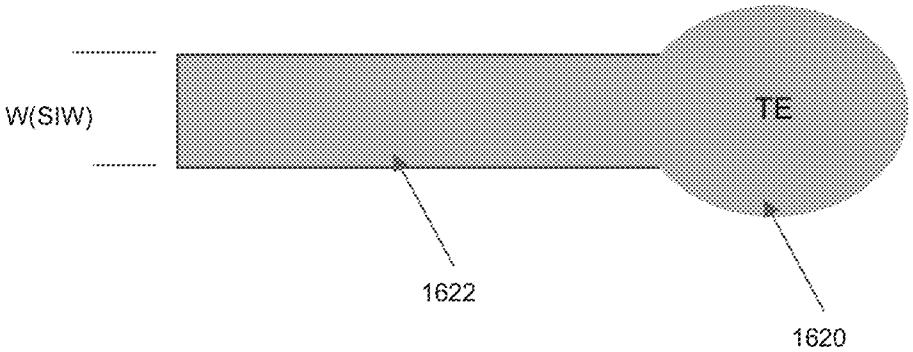

FIG. 29 illustrates another example having a circular shape of a TE 1620. The dimension of TE 1620 compared to a dimension of the SIW 1622 is designed to support a given frequency of operation for a transmission signal through SIW 1622 and to support a given bandwidth. Additionally, various shapes and sizes may be implemented to reduce insertion loss and achieve a desired result.

Figure 30:
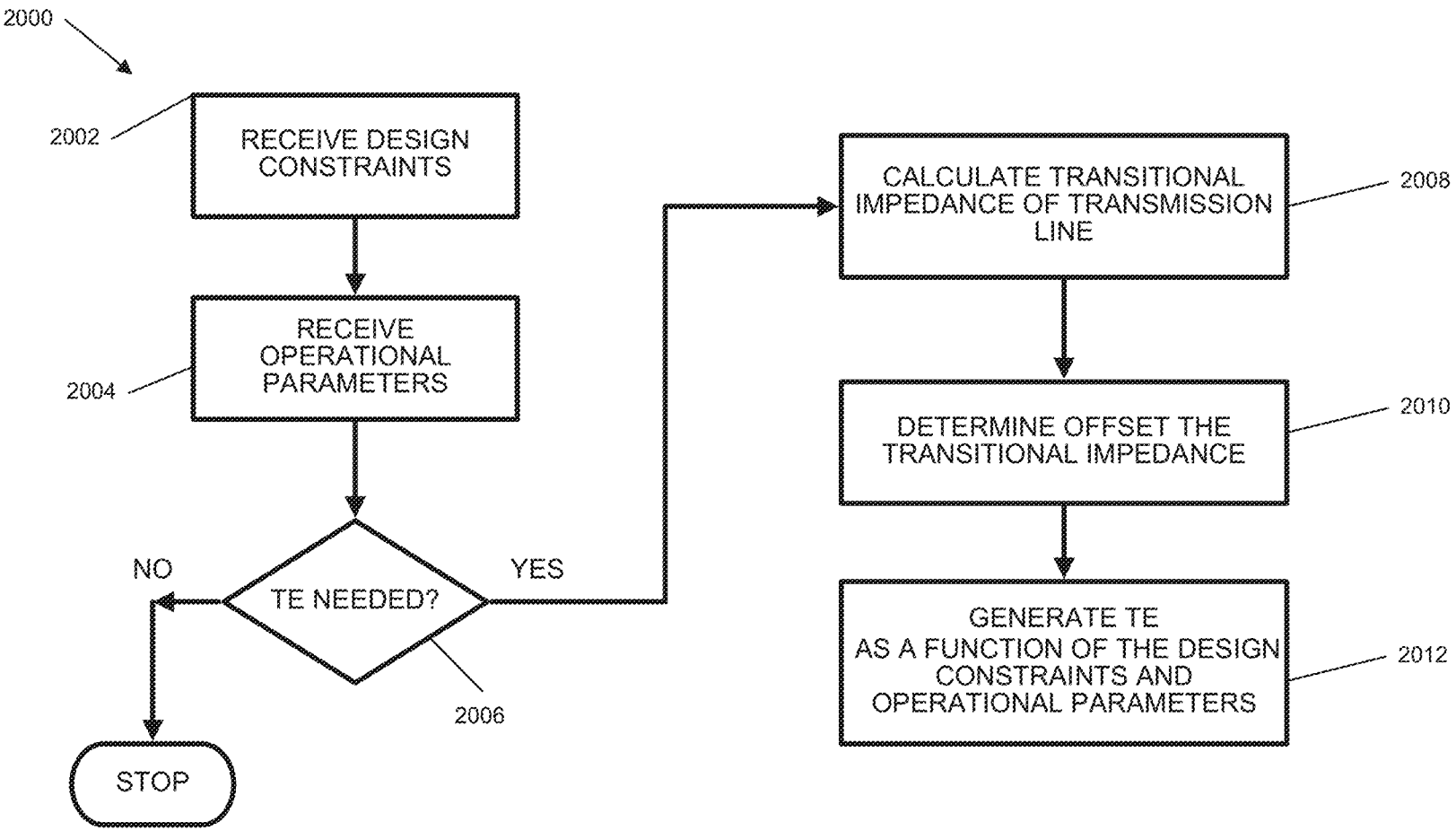
FIG. 30 is a flow chart illustrating a process for generating a transition element, according to various implementations of the subject technology.

FIG. 30 is a flow chart of a process for generating a transition element. The process 2000 starts with the design constraints 2002 and operational parameters 2004 to determine if a TE is needed, 2006. If TE is not needed, e.g., NO as shown in FIG. 30, the process 2000 proceeds to STOP. If TE is needed, e.g., YES as shown in FIG. 30, the process 2000 proceeds to 2008: Design of a TE involves calculation of a transitional impedance of a transmission line, 2008, to determine an offset transitional impedance 2010. This information enables generation of a TE structure as a function of design constraints and operational parameters, 2012. Design constraints include the height or elevation of a multilayer substrate, the layout of circuitry, the transition points, the type of transmission lines coupled, dimensions of transmission line, and so forth. The operational constraints include frequency of operation, bandwidth, return loss, and other parameters. A variety of shapes, configurations, and designs may be implemented to achieve a transitional impedance. In some situations, a dimension of a transitional element, such as a width, may be less than the same dimension of the TE. In some examples, the shape of a TE is amorphous, and in other examples the shape of a TE is a geometric shape.

It is appreciated that the disclosed examples are a dramatic contrast to the traditional complex systems incorporating multiple antennas controlled by digital beam forming. The disclosed examples increase the speed and flexibility of conventional systems, while reducing the footprint and expanding performance.

The disclosed radar system (e.g., the radar system 100 of FIG. 1) may implement the various aspects, configurations, processes and modules described throughout this description. The radar system is configured for placement in an autonomous driving system or in another structure in an environment (e.g., buildings, billboards, along roads, road signs, traffic lights, etc.) to complement and supplement information of individual vehicles, devices and so forth. The radar system scans the environment, and may incorporate infrastructure information and data, to alert drivers and vehicles as to conditions in their path or surrounding environment. The radar system is also able to identify targets and actions within the environment. The various examples described herein support autonomous driving with improved sensor performance, all-weather/all-condition detection, advanced decision-making algorithms and interaction with other sensors through sensor fusion. The radar system leverages intelligent metamaterial antenna structures and artificial intelligence ("AI") techniques to create a truly intelligent digital eye for autonomous vehicles, which can include Level 1, Level 2, Level 3, Level 4, or Level 5 vehicles (i.e. any vehicle having some capability of autonomous driving, from requiring some driver assistance to full automation).

It is appreciated that the transition elements described herein may take any of a variety of shapes provided a dimensional and an inductance change for transitions between circuits, layers, modules, and so forth. In the present examples, the transition elements provide transition inductance and effectively change the inductance of the transition points.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein.

What is claimed is:

1. An integrated circuit, comprising:

a plurality of layers of different compositions comprising at least one conductive material and at least one dielectric material;

substrate integrated waveguide (SIW) portions coupled to the plurality of layers;

coplanar waveguide (CPW) portions coupled to the SIW portions;

at least one electromagnetic signal path formed within the plurality of layers; and at least one transition coupling the SIW portions and the CPW portions, wherein the at least one transition has a width larger than the SIW portions.

2. The integrated circuit of claim 1, wherein each of the at least one transition comprises a respective transition element coupled to a corresponding conductor.

3. The integrated circuit of claim 2, wherein the respective conductor of the at least one transition is coupled to at least one of the CPW portions.

4. The integrated circuit of claim 2, wherein the respective conductor of the at least one transition is formed within at least a portion of the plurality of layers.

5. The integrated circuit of claim 2, wherein the respective transition element of each of the at least one transition comprises a respective resistive component and a respective inductive component that offsets a respective capacitive component of at least one of the SIW portions.

6. The integrated circuit of claim 2, wherein the respective transition element of each of the at least one transition has dimensions configured to provide an inductance.

7. The integrated circuit of claim 2, wherein the respective transition element of each of the at least one transition has different dimensions than the SIW portions.

8. The integrated circuit of claim 1, wherein the integrated circuit is an antenna device.

9. The integrated circuit of claim 8, wherein the antenna device is employed in an autonomous vehicle.

10. The integrated circuit of claim 1, wherein at least one of the SIW portions is positioned within an antenna array layer of the plurality of layers and forms a slotted antenna.

11. A transition in a multilayer substrate, comprising:

a substrate integrated waveguide (SIW) portion in a first layer of the multilayer substrate;

a coplanar waveguide (CPW) portion on a second layer of the multilayer substrate, wherein the second layer is different from the first layer;

a conductor coupled to the CPW portion and through the first and second layers; and a transition element configured to couple the SIW portion to the conductor.

12. The transition of claim 11, wherein the transition element has a width larger than the SIW portion.

13. The transition of claim 11, wherein the conductor is formed within at least a portion of a plurality of layers of the multilayer substrate.

14. The transition of claim 11, wherein the transition element comprises a resistive component and an inductive component that offsets a capacitive component of the SIW portion.

15. The transition of claim 11, wherein the transition element has dimensions configured to provide an inductance.

16. The transition of claim 11, wherein the transition element has different dimensions than the SIW portion.

17. The transition of claim 11, wherein the multilayer substrate is an antenna device.

18. The transition of claim 17, wherein the antenna device is employed in an autonomous vehicle.

19. The transition of claim 11, wherein the SIW portion is positioned within an antenna array layer of the multilayer substrate and forms a slotted antenna.

20. A process for preparing a connection in a multilayer substrate, comprising:

determining connecting layers of the multilayer substrate;

determining a transmission line reactance of the connecting layers; and generating a transition having a reactance to offset the transmission line reactance by using design constraints and operational parameters of the multilayer substrate, wherein the design constraints comprise at least one of a height or elevation of the multilayer substrate, a layout of circuitry, transition points, a type of transmission lines coupled, or dimensions of the transmission line, and wherein the operational parameters comprise at least one of a frequency of operation, a bandwidth, or a return loss.

* * * * *